US009099236B2

(12) United States Patent
Nomura et al.

(10) Patent No.: US 9,099,236 B2
(45) Date of Patent: Aug. 4, 2015

(54) REACTOR

(75) Inventors: Yasushi Nomura, Osaka (JP); Atsushi Ito, Osaka (JP); Akinori Ooishi, Yokkaichi (JP); Takahiro Onizuka, Yokkaichi (JP); Yoshiaki Matsutani, Yokkaichi (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 0 days.

(21) Appl. No.: 13/882,397

(22) PCT Filed: Nov. 4, 2011

(86) PCT No.: PCT/JP2011/075375

§ 371 (c)(1),
(2), (4) Date: Apr. 29, 2013

(87) PCT Pub. No.: WO2012/066938

PCT Pub. Date: May 24, 2012

(65) Prior Publication Data

US 2013/0222100 A1 Aug. 29, 2013

(30) Foreign Application Priority Data

Nov. 19, 2010 (JP) ..... 2010-259467

(51) Int. Cl.
*H01F 27/02* (2006.01)
*H01F 27/24* (2006.01)
(Continued)

(52) U.S. Cl.
CPC ..... *H01F 27/008* (2013.01); *H01F 27/025* (2013.01); *H01F 27/22* (2013.01); *H01F 37/00* (2013.01); *H01F 41/02* (2013.01); *Y10T 29/49073* (2015.01)

(58) Field of Classification Search
CPC ..... H01F 27/22
See application file for complete search history.

(56) References Cited

U.S. PATENT DOCUMENTS 4,112,481 A * 9/1978 Roge et al. ..... 361/736
6,392,519 B1 * 5/2002 Ronning ..... 336/90
(Continued)

FOREIGN PATENT DOCUMENTS

CN 1666303 A 9/2005
CN 101443860 A 5/2009
(Continued)

OTHER PUBLICATIONS

International Search Report in PCT International Patent Application No. PCT/JP2011/075375, dated Dec. 20, 2011.
Notification of the First Office Action issued in Chinese Application No. 201180052297.0 dated Mar. 10, 2015.

*Primary Examiner* — Elvin G Enad
*Assistant Examiner* — Ronald Hinson
(74) *Attorney, Agent, or Firm* — Venable LLP; Michael A. Sartori; Tamatane J. Aga

(57) ABSTRACT

A reactor 1 of the present invention includes: a combined product 10 provided with a coil 2 and a magnetic core 3 where the coil 2 is disposed; and a case 4 storing the combined product 10. The case 4 includes: a bottom plate portion 40 fixed to a fixation target when the reactor 1 is installed in the fixation target; a side wall portion 41 attached to the bottom plate portion 40 to surround the combined product 10; and a heat dissipation layer 42 formed on the inner face of the bottom plate portion 40 to be interposed between the bottom plate portion 40 and the coil 2. The bottom plate portion 40 is made of aluminum, and the side wall portion 41 is made of an insulating resin. The heat dissipation layer 42 is made of an adhesive agent whose thermal conductivity is high and which exhibits an excellent insulating characteristic. Since the bottom plate portion 40 is structured as a separate member from the side wall portion 41, the heat dissipation layer 42 can easily be formed and, moreover, the heat dissipation layer 42 can be made of a material possessing an excellent heat dissipating characteristic. Since the insulator 5 evenly presses the coil 2 against the heat dissipation layer 42, an even more excellent heat dissipating characteristic is achieved.

6 Claims, 7 Drawing Sheets

(51) Int. Cl.

| | |
|---|---|
| ***H01F 27/00*** | (2006.01) |
| ***H01F 27/22*** | (2006.01) |
| ***H01F 37/00*** | (2006.01) |
| ***H01F 41/02*** | (2006.01) |

(56) References Cited

U.S. PATENT DOCUMENTS

| | | | | |
|---|---|---|---|---|
| 2009/0144967 | A1 * | 6/2009 | Hasu et al. | 29/605 |
| 2009/0197102 | A1 | 8/2009 | Okamoto et al. | |
| 2012/0154100 | A1 | 6/2012 | Hasu et al. | |

FOREIGN PATENT DOCUMENTS

| | | | |
|---|---|---|---|
| JP | 2006-351675 | A | 12/2006 |
| JP | 2007-129149 | A | 5/2007 |
| JP | 2008-305854 | A | 12/2008 |
| JP | 2009-267197 | A | 11/2009 |
| JP | 2010-050408 | A | 3/2010 |
| JP | 2010-263075 | A | 11/2010 |
| JP | 2011-243943 | A | 12/2011 |

* cited by examiner

REACTOR

TECHNICAL FIELD

The present invention relates to a reactor used as a constituent component of a power converter apparatus such as an in-vehicle DC-DC converter installed in a vehicle such as a hybrid vehicle, and a method for manufacturing the same. In particular, the present invention relates to a reactor being small in size and possessing an excellent heat dissipating characteristic.

BACKGROUND ART

One of the components of a circuit that steps up or steps down voltage is a reactor. For example, Patent Literature 1 discloses a reactor that is used in a converter installed in a vehicle such as a hybrid vehicle. The reactor includes a coil, an annular magnetic core where the coil is disposed, a case storing a combined product made up of the coil and the magnetic core, and a sealing resin with which the case is filled. Generally, the reactor is used as being fixed to a cooling base for cooling the coil and the like, which produce heat when being energized.

The representative case is a die casting product made of aluminum. The case is used as being fixed to the cooling base to serve as a heat dissipation path for dissipating heat from the coil and the like.

CITATION LIST

Patent Literature

Patent Literature 1: Japanese Unexamined Patent Publication No. 2010-050408

SUMMARY OF INVENTION

Technical Problem

In recent years, a further reduction in size and weight is desired for in-vehicle components of a hybrid vehicle and the like. However, such a further reduction in size is difficult to achieve with the reactor which includes the conventional aluminum case.

Since aluminum is an electrically conductive material, the case must electrically be insulated at least from the coil. Accordingly, normally, a relatively great interval is provided between the coil and the inner face (the bottom face and the sidewall face) of the case, in order to secure an electrical insulating distance. In terms of securing the insulating distance, a reduction in size is difficult.

For example, a reduction in size of the reactor can be achieved by eliminating the case. However, this will expose the coil and the magnetic core. Therefore, the coil and the magnetic core cannot be protected from the external environment such as dust and corrosion, or provided with mechanical protection such as strength.

Further, the sealing resin with which the case is filled desirably possesses an excellent heat dissipating characteristic. For example, the heat dissipating characteristic can be enhanced by employing resin containing a filler made of ceramic as the sealing resin. However, since the outer shape of the combined product made up of the coil and the magnetic core is in a complicated shape, an attempt to fill the case with the resin containing the filler while avoiding generation of any clearance or void between the combined product and the inner face of the case takes time, resulting in poor productivity of the reactor. Further, though the heat dissipating characteristic can be improved by increasing the filler content in the sealing resin, the sealing resin becomes brittle and hence becomes prone to be damaged by any thermal shock. Accordingly, development of the reactor with an excellent heat dissipating characteristic without use of the sealing resin containing the filler is desired.

Accordingly, one object of the present invention is to provide a reactor possessing an excellent heat dissipating characteristic while being small in size. Further, another object of the present invention is to provide a manufacturing method of the reactor.

Solution to Problem

The present invention achieves the objects stated above by: structuring the case as a dividable component; including a heat dissipation layer possessing an excellent heat dissipating characteristic at a portion structuring the inner bottom face of the case; and pressing the face of the coil being disposed on the inner bottom face side of the case against the heat dissipation layer.

A reactor according to the present invention includes a combined product and a case storing the combined product, the combined product including a coil formed by a wire being spirally wound and a magnetic core where the coil is disposed. The combined product includes an insulator insulating the coil and the magnetic core from each other. The case includes a bottom plate portion being fixed to a fixation target when the reactor is installed in the fixation target, a side wall portion that is fixed to the bottom plate portion by a fixation member and that surrounds the combined product, and a heat dissipation layer formed on an inner face of the bottom plate portion to be interposed between the bottom plate portion and the coil. The bottom plate portion is equal to or higher than the side wall portion in thermal conductivity, the heat dissipation layer is structured by an insulating material whose thermal conductivity is higher than 2 W/m·K. Further, the insulator includes an installation face portion being interposed between an inner circumferential face of the coil and the magnetic core, and a pressing mechanism pressing the installation face portion against the inner circumferential face of the coil in order to bring the coil into contact evenly with the heat dissipation layer. The "insulating characteristic" of the insulating material refers to the voltage withstanding characteristic with which the coil and the bottom plate portion can electrically be insulated from each other.

As a method for manufacturing the reactor of the present invention, for example, the following method for manufacturing the reactor of the present invention can suitably be used. The method for manufacturing the reactor of the present invention includes: preparing a combined product made up of a coil and a magnetic core by assembling the coil made of a wire being spirally wound and the magnetic core; and storing the combined product in a case, the case including a bottom plate portion and a side wall portion provided to stand upright from the bottom face portion to surround the combined product. The method further includes the step of forming a heat dissipation layer, the step of pressing the coil, and the step of assembling the case.

The step of forming a heat dissipation layer: the step of forming a heat dissipation layer made of an insulating material whose thermal conductivity is higher than 2 W/m·K on the inner face of the bottom plate portion of the case.

The step of pressing the coil: the step of disposing an insulator between the coil and the magnetic core for insulating the coil and the magnetic core from each other; and causing the insulator to press the coil against the heat dissipation layer so that the coil is brought into contact evenly with the heat dissipation layer.

The step of assembling the case: the step of attaching the side wall portion to the bottom plate portion by a fixation member to form the case.

Note that the order of the step of pressing the coil and the step of assembling the case is interchangeable.

With the reactor of the present invention, since the face of the coil that is positioned on the installation side when the reactor is installed in the fixation target (hereinafter referred to as the coil installation face) is brought into contact with the heat dissipation layer, the heat from the coil can efficiently be transferred to the heat dissipation layer. Then, via the heat dissipation layer, the heat can be released to the fixation target such as the cooling base. Thus, an excellent heat dissipating characteristic is exhibited. In particular, since the heat dissipation layer is made of an insulating material, even when the bottom plate portion is made of a conductive material, the coil and the bottom plate portion can surely be insulated from each other, by the coil being brought into contact with the heat dissipation layer. Accordingly, the thickness of the heat dissipation layer can be reduced. In this term also, the heat of the coil is easily released to the fixation target. Thus, the reactor of the present invention possesses an excellent heat dissipating characteristic. Further, since the bottom plate portion is made of a material whose thermal conductivity is at least equal to or higher than that of the side wall portion, the heat from the coil installation face can efficiently be released via the heat dissipation layer. Thus, the reactor of the present invention possesses an excellent heat dissipating characteristic. In particular, since the bottom plate portion and the side wall portion are structured as separate members, they can be made of different materials. For example, when the bottom plate portion is made of a material higher in thermal conductivity than that of the side wall portion, the reactor possessing a further excellent heat dissipating characteristic can be obtained.

Further, with the reactor of the present invention and the method for manufacturing the same, by the insulator pressing the coil against the heat dissipation layer, i.e., more specifically, by the pressing mechanism allowing the installation face portion of the insulator to be pressed against the inner circumferential face of the coil, the turns forming the coil installation face are aligned, and hence the coil installation face can be brought into contact evenly with the heat dissipation layer. That is, the contact area between the coil installation face and the heat dissipation layer can fully be secured. In terms of the foregoing also, the reactor of the present invention possesses an excellent heat dissipating characteristic.

Here, as the wire forming the coil, what is generally used is a coated wire provided with an insulating coat made of an insulating material on the outer circumference of a conductor made of a conductive material. Using the coated wire, for example, in the case where the wire is wound with reference to the internal dimension (inner circumferential dimension) of the coil, the external dimension of the coil (outer circumferential dimension) is associated with the dimension error during the winding process and the dimension error of the wire (dimension error of the conductor and the dimension error of the insulating coat (twice as great as the thickness at a maximum)) as the dimension error. In particular, when the end face shape of the coil is quadrangular such as rectangular, the dimension error of one side of the quadrangle involves, at a maximum, the sum of the dimension error during the winding process and the error twice as great as the dimension error of the wire. The precision of the external dimension of the coil is prone to be reduced by those errors. That is, the outer circumferential face of the coil formed by a plurality of turns being paralleled is prone to be uneven. Thus, the turns forming the coil installation face may fail to be in contact with the heat dissipation layer fully closely.

In the case where the wire whose conductor is a rectangular wire is used and where the rectangular coil is formed by edgewise winding, if the corner portion is formed by the wire being bent exactly at a right angle (90°), then springback occurs. Accordingly, bending is performed at an angle with an allowance for the springback. However, when the number of turns increases, the weight of the coil after being wound becomes great. Thus, even when such bending with an allowance is performed, the winding angle deviates by the inertia. Further, in the case where the number of turns increases, the wound volume of the wire wound around the unwinding bobbin supplying the wire also increases. Accordingly, since the state of curl is different depending on the position of the wire wound around the unwinding bobbin, for example, between the initial unwinding state and near the terminal state, the winding angle varies. Because of the deviation of the bent state, when the rectangular edgewise coil is seen from, for example, the end face of the coil, the corner portion of the turns appears to gradually deviate like a spiral staircase. This deviation may also cause the outer circumferential face of the coil to become uneven, and the turns structuring the coil installation face may fail to be in contact with the heat dissipation layer fully closely.

With the corner portions each bent at 90° in the edgewise coil, it is extremely difficult to correct the angle deviation for each turn, particularly because the rectangular wire is work-hardened. However, it is possible to correct the shape deviated in the aforementioned spiral staircase-like manner to have smaller deviation (for example, to become a rectangular tubular element). By an appropriate correction, all the turns can be aligned and the uneven outer circumferential face of the coil, in particular, the coil installation face, can approximate a smooth face, or can substantially be smoothed. Smoothing the coil installation face, the contact area with the heat dissipation layer can be increased. Preferably, all the turns structuring the coil installation face can surely be brought into contact with the heat dissipation layer. Accordingly, with reactor of the present invention, as described above, the insulator allows the inner circumferential face of the coil to press, to thereby align the turns forming the coil installation face. Further, by the turns being aligned, the corner portions of the turns are aligned even when the rectangular coil is used. Accordingly, there is no possibility for part of the corner portion to project because of the deviation described above, to damage the heat dissipation layer. Accordingly, even when the case is made of a conductive material such as a metal material, the insulation between the coil and the case can fully be secured by the heat dissipation layer made of an insulating material. Further, provision of the insulator makes it possible for the reactor of the present invention to enhance insulation between the coil and the magnetic core.

Further, a reduction in thickness of the heat dissipation layer as described above can reduce the interval between the face of the coil on the installation side and the inner face of the bottom plate portion, whereby a reduction in size of the reactor can be achieved. Further, with the reactor of the present invention, since the bottom plate portion and the side wall portion are formed as separate members, the materials of the bottom plate portion and the side wall portion can easily be changed. For example, employing a material possessing an excellent electrical insulating characteristic as the material of the side wall portion, the interval between the outer circumferential face of the coil and the inner circumferential face of the side wall portion can also be reduced. Hence, a further reduction in size of the reactor can be achieved.

In addition, with the reactor of the present invention, provision of the heat dissipation layer makes it possible to efficiently dissipate heat at least from the coil installation face via the heat dissipation layer, as described above. Therefore, for example, with the mode in which the case is filled with a sealing resin, the heat dissipating characteristic can be enhanced by the heat dissipation layer even when resin being poor in thermal conductivity is used. Accordingly, with the reactor of the present invention, the degree of freedom in selecting usable sealing resin can be increased. For example, resin containing no filler can be used. Alternatively, even when the mode in which the sealing resin is not included is employed, a full heat dissipating characteristic can be secured by the heat dissipation layer.

Furthermore, with the reactor of the present invention, since the bottom plate portion and the side wall portion are separate members that are attached by the fixation member, the heat dissipation layer can be formed in the state where the side wall portion is removed. Here, the heat dissipation layer can be formed with a conventional case whose bottom face and sidewall are integrally molded and cannot be separated, for example at the inner bottom face with which the coil can be brought into contact. However, in this case, the heat dissipation layer cannot be formed with ease because the sidewall becomes an obstacle. In contrast thereto, with the reactor of the present invention and the manufacturing method of the present invention, the heat dissipation layer can be formed with ease, and excellent manufacturability of the reactor can be achieved. Further, with the reactor of the present invention, provision of the case realizes protection of the coil and the magnetic core from the environment, and mechanical protection can be achieved.

In one mode of the present invention, the magnetic core may include an inner core portion where the coil is disposed, and an outer core portion where the coil is not disposed and exposed outside the coil, the insulator may include a surrounding wall portion disposed at an outer circumference of the inner core portion to be interposed between the coil and the inner core portion, and a frame-like portion abutting on an end face of the coil to be interposed between the coil and the outer core portion. In particular, in this mode, the surrounding wall portion and the frame-like portion each may have an engaging portion for engaging with each other, the surrounding wall portion may include the installation face portion, the frame-like portion may have a projecting portion pressing the installation face portion against the inner circumferential face of the coil when the frame-like portion is assembled with the surrounding wall portion, and the pressing mechanism may be structured by the engaging portion and the projecting portion.

According to the mode described above, by assembling the insulator to press the frame-like portion engaging with the installation face portion, the projecting portion of the frame-like portion presses the installation face portion toward the heat dissipation layer. Further, the installation face portion presses the inner circumferential face of the coil toward the heat dissipation layer. As a result, the turns forming the inner circumferential face of the coil are aligned, and the inner circumferential face is smoothed. Also, the outer circumferential face of the coil facing the inner circumferential face easily becomes smooth. That is, the unevenness in the coil installation face due to the errors is corrected, and the contact area with the heat dissipation layer can fully be secured.

In particular, in the case where the wire whose conductor is a rectangular wire is used, the outer circumferential face of the coil can easily approximate a flat plane as compared to the case where the conductor is a round wire. Thus, the contact area between the coil installation face and the heat dissipation layer can more easily be secured. Further, forming the edgewise coil in which the wire whose conductor is the rectangular wire is used, the coil with high space factor can easily be obtained, and a reduction in size can be achieved with ease.

In one mode of the present invention, the heat dissipation layer may be a multilayer structure structured by an insulating adhesive agent, and the bottom plate portion may be structured by a conductive material.

Since the heat dissipation layer is made of an insulating adhesive agent, adhesion between the coil and the heat dissipation layer can be enhanced. In particular, as described above, since the installation side region of the turns of the coil is aligned by the insulator, the coil can fully be in close contact with the heat dissipation layer made of the insulating adhesive agent. Further, since the heat dissipation layer is a multilayer structure, despite the small thickness of the adhesive agent layer per layer, the electrical insulating performance can be enhanced. Here, when the adhesive agent layer is reduced in thickness as much as possible, the distance between the coil and the bottom plate portion can be reduced, and hence the reactor can be reduced in size. However, when the adhesive agent layer is reduced in thickness, pinholes may be produced. In contrast, employing the multilayer structure, a pinhole in a certain layer can be closed by adjacent separate layer. Thus, the heat dissipation layer possessing an excellent insulating performance can be obtained. The thickness per layer and the number of pieces of layers can arbitrarily be selected. The greater the total thickness, the higher the insulation performance; and the smaller the total thickness, the higher the heat dissipating characteristic. With the material exhibiting an excellent insulating performance, adequate heat dissipating characteristic and insulating performance can be obtained even with thin adhesive agent layers and small number of pieces of layers. For example, the heat dissipation layer may have the total thickness of 2 mm or less; furthermore, 1 mm or less; and particularly, 0.5 mm or less. On the other hand, when the bottom plate portion is made of a conductive material, representatively metal such as aluminum, the heat dissipating characteristic of the reactor can further be enhanced, because such metal generally possesses an excellent heat dissipating characteristic. Further, even though the bottom plate portion is made of a conductive material, the electrical insulation between the coil and the bottom plate portion can be secured because the heat dissipation layer is made of an insulating material, as described above.

In one mode of the present invention, the side wall portion may be made of an insulating material.

Similarly to the bottom plate portion described above, the side wall portion may also be made of a conductive material such as aluminum. In this case, the heat dissipating characteristic can be enhanced. Further, since the case is made of an electrically conductive and non-magnetic material, the case functions as a magnetic shield, whereby leakage flux can be suppressed. On the other hand, since the side wall portion is made of an insulating material, the side wall portion and the coil are insulated from each other. Therefore, the interval between the inner face of the side wall portion and the outer circumferential face of the coil can be reduced, and a further reduction in size can be achieved. Further, when the insulating material is a material lighter than a metal material such as resin, the case being lighter in weight than the conventional aluminum case can be obtained.

In one mode of the present invention, the heat dissipation layer may be a multilayer structure structured by an epoxy base adhesive agent containing an alumina filler, the bottom plate portion may be structured by aluminum or aluminum alloy, and the side wall portion may be structured by an insulating resin.

The epoxy base adhesive agent containing an alumina filler is excellent in both the insulating characteristic and the heat dissipating characteristic. For example, it can satisfy the condition of the thermal conductivity being 3 W/m·K or more. Accordingly, in accordance with the mode, a further excellent heat dissipating characteristic can be achieved. Further, employing the multilayer structure, an excellent electrical insulating characteristic can be secured even with thin adhesive agent layers, as described above. Still further, by reducing the thickness of the adhesive agent layer, a reduction in size of the reactor can be achieved as described above. Still further, aluminum or aluminum alloy is high in thermal conductivity (aluminum; 237 W/m·K). Accordingly, according to the present mode including the bottom plate portion made of aluminum or the like, the heat of the coil can efficiently be released to the fixation target such as a cooling base using the bottom plate portion as the heat dissipation path. Thus, a further excellent heat dissipating characteristic can be achieved. Further, according to the present mode including the side wall portion made of an insulating resin, since the interval between the coil and the side wall portion can be reduced, a further reduction in size of the reactor can be achieved.

Advantageous Effect of Invention

The reactor of the present invention is small in size and possesses an excellent heat dissipating characteristic.

BRIEF DESCRIPTION OF DRAWINGS

FIG. 1 is a schematic perspective view showing a reactor according to an embodiment.

FIG. 2 is an exploded perspective view schematically showing the reactor according to the embodiment.

FIG. 3 (B) is an exploded perspective view schematically showing inner core portions structuring the magnetic core.

FIG. 4 (B) is a plan view of the insulator.

FIG. 5 is a schematic cross sectional view of the combined product made up of the coil and the magnetic core included in the reactor according to the embodiment taken along the axial direction of the coil.

FIG. 6 is an explanatory view describing an assembling step of the combined product made up of the coil and the magnetic core included in the reactor according to the embodiment.

FIG. 7 is an exploded perspective view schematically showing the combined product made up of the coil and the magnetic core according to another embodiment.

DESCRIPTION OF EMBODIMENTS

Figure 1:
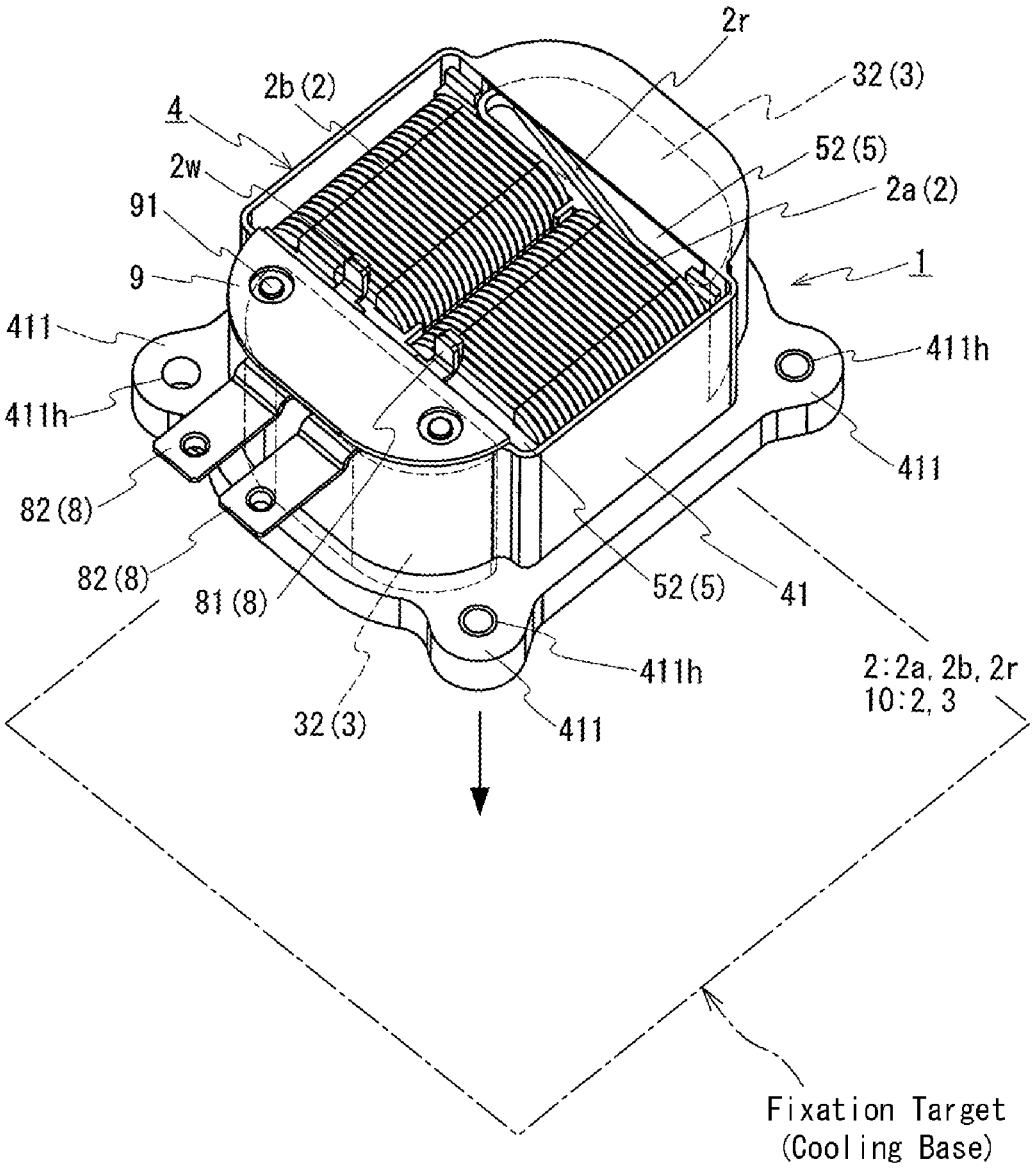
[FIG. 1]

In the following, with reference to FIGS. 1 to 6, a description will be given of embodiments of the present invention. In the drawing, identical reference symbols are allotted to identically named elements. Note that, in the following description, the installed side when the reactor is installed is regarded to be the bottom side, and the side opposite thereto is regarded to be the top side.

<<Overall Structure>>

The reactor 1 includes a combined product 10 made up of a coil 2 and a magnetic core 3 around which the coil 2 is disposed, and a case 4 storing the combined product 10. The case 4 is a box-like element whose one face is open. Representatively, the case 4 is filled with a sealing resin (not shown), and the combined product 10 is buried in the sealing resin except for the end portions of wire 2*w* forming the coil 2. Further, the combined product 10 includes an insulator 5 insulating between the coil 2 and the magnetic core 3. The reactor 1 is characterized in that the case 4 is structured so that it can be divided, and is characterized by the shape of the insulator 5. In the following, the constituents will be described in more detail.

<<Combined Product>>

[Coil]

A description will be given of the coil 2 with reference to FIGS. 2 and 3 as appropriate. The coil 2 includes a pair of coil elements 2*a* and 2*b* made of a single continuous wire 2*w* with no joined portion being spirally wound, and a coil couple portion 2*r* coupling the coil elements 2*a* and 2*b*. The coil elements 2*a* and 2*b* are identical to each other in the number of turns. The shape of each of the coil elements 2*a* and 2*b* as seen in the axial direction (i.e., the end face shape) is substantially quadrangular (i.e., a rectangular shape with rounded corners). The coil elements 2*a* and 2*b* are laterally juxtaposed to each other such that their respective axial directions are in parallel to each other. On the other end side of the coil 2 (on the depth side in FIG. 2), the wire 2*w* is partially bent in a U-shape, to form the coil couple portion 2*r*. Thus, the coil elements 2*a* and 2*b* are structured to be wound in the identical direction.

The wire 2*w* is suitably a coated wire, which includes a conductor made of a conductive material such as copper or aluminum, the conductor being provided with an insulating coat made of an insulating material around its outer circumference. Here, what is used is a coated rectangular wire whose conductor is a copper-made rectangular wire and the insulating coat is made of enamel (polyamide-imide, representatively). The thickness of the insulating coat is preferably 20 μm or more and 100 μm or less. As the thickness is greater, the pinholes become fewer, whereby the electrical insulating characteristic is enhanced. The coil elements 2*a* and 2*b* are each the coated rectangular wire being wound edgewise, to be formed into a hollow square sleeve-like shape. The wire 2*w* is not limited to those whose conductor is a rectangular wire, and wires of various shapes whose cross section is circular, elliptical, polygonal and the like may be used. As compared to the case where a round wire whose cross section is circular is used, with the rectangular wire, a coil being high in space factor can be formed easier. Further, use of the rectangular wire can more easily secure the wider contact area with a heat dissipation layer 42, whose description will be given later, as compared to the case where a round wire is used, because the face of the coil 2 serving as the installed side when the reactor 1 is installed in a fixation target (i.e., a coil installation face 2*d* (FIG. 5)) substantially has the area based on the product of the thickness of the rectangular wire and the number of turns. Note that, it is also possible to employ the mode in which the coil elements are prepared from separate wires, and the end portions of the wires forming respective coil elements are joined by welding or the like, to obtain an integrated coil.

The opposite end portions of the wires 2*w* forming the coil 2 are appropriately drawn out from the turn forming portion at one end side (i.e., the near side in FIG. 2) of the coil 2 to the outside of the case 4 (FIG. 1). The drawn out opposite end portions of the wire 2*w* have the conductor portions exposed by the insulating coat being peeled off. To each of the exposed conductor portions, terminal hardware 8 made of an electrically conductive material is connected. Via the terminal hardware 8, an external apparatus (not shown) such as a power supply supplying power to the coil 2 is connected. The terminal hardware 8 will be detailed later.

[Magnetic Core]

A description will be given of the magnetic core 3 with reference to FIGS. 3 and 5 as appropriate. The magnetic core 3 includes a pair of inner core portions 31 around which the coil elements 2*a* and 2*b* are respectively disposed, and a pair of outer core portions 32 around which no coil 2 is disposed and hence exposed outside the coil 2. Here, the inner core portions 31 are each a rectangular parallelepiped-shaped (with rounded corners in the embodiment), and the outer core portions 32 are each a prism element having a pair of trapezoidal-shaped faces. The magnetic core 3 is structured such that the outer core portions 32 clamp the inner core portions 31, which are disposed to be away from each another. Further, the end faces 31*e* of the inner core portions 31 and the inner end faces 32*e* of the outer core portions 32 are brought into contact to each other, so as to form an annular shape. When the coil 2 is excited, the inner core portions 31 and the outer core portions 32 form a closed magnetic path.

Figure 3:
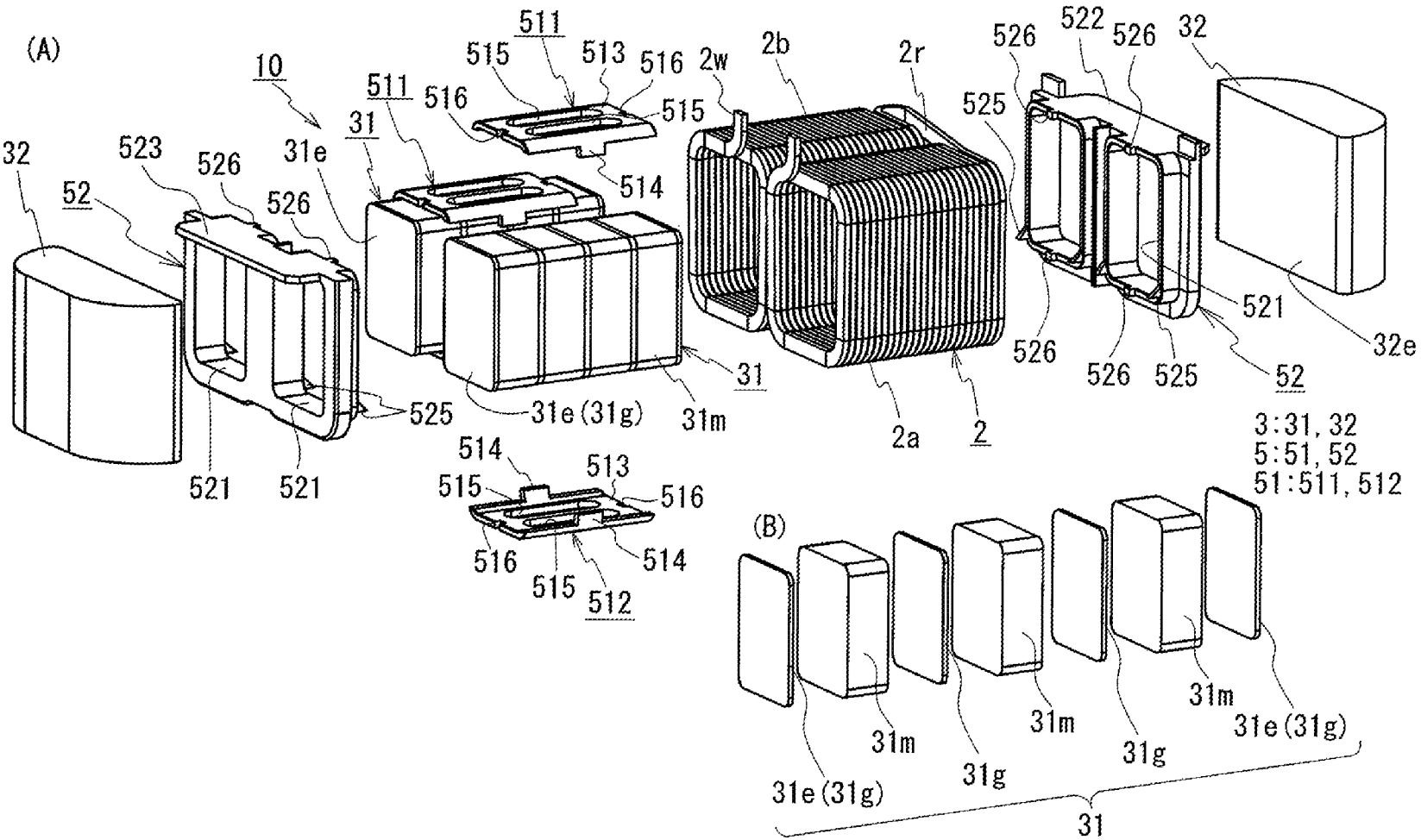
[FIG. 3] FIG. 3 (A) is an exploded perspective view schematically showing a combined product made up of a coil and a magnetic core included in the reactor according to the embodiment.

The inner core portions 31 are lamination products in which core pieces 31*m* (not shown in FIG. 5) made of a magnetic material and gap members 31*g* (not shown in FIG. 5) representatively made of a non-magnetic material are alternately laminated (FIG. 3 (B)), while the outer core portions 32 are each a core piece made of a magnetic material. The core pieces may each be a molded product using magnetic powder, or a lamination product made up of a plurality of magnetic thin plates (e.g., electromagnetic steel sheets) provided with insulating coating being laminated.

The exemplary molded product may be: a powder magnetic core using powder of: iron group metal such as Fe, Co, Ni and the like, Fe-base alloy such as Fe—Si, Fe—Ni, Fe—Al, Fe—Co, Fe—Cr, Fe—Si—Al and the like, rare-earth metal, or a soft magnetic material such as an amorphous magnetic element; a sintered product obtained by sintering the above-noted powder having undergone press molding; and a hardened mold product obtained by subjecting a mixture of the above-noted powder and resin to injection molding, cast molding and the like. In addition, each core piece may be a ferrite core being a sintered product of a metal oxide. With the molded product, magnetic cores of various three-dimensional shapes can easily be formed.

As the powder magnetic core, what can suitably be used is the powder of the soft magnetic material noted above, with its surface being provided with an insulating coating. In this case, the powder magnetic core is obtained by molding the powder and thereafter subjecting the molded powder to thermal treatment at a temperature equal to or lower than the heat resistant temperature of the insulating coating. Representative insulating coating may be those made of silicone resin, phosphate or the like.

The inner core portions 31 and the outer core portions 32 may be different from each other in material. For example, when the inner core portions 31 are the powder magnetic cores or the lamination products while the outer core portions 32 are the hardened mold products, the saturation magnetic flux density of the inner core portions 31 can easily be increased to be higher than that of the outer core portions 32. Here, the core pieces are powder magnetic cores of soft magnetic powder containing iron such as iron or steel.

The gap members 31*g* are each a plate-like member disposed at the clearance, which is provided between the core pieces 31*m* for the purpose of adjusting inductance. The material of the gap members 31*g* is those having permeability lower than that of the core pieces, such as alumina, glass epoxy resin, unsaturated polyester and the like. Representatively, the material of the gap members 31*g* is a non-magnetic material (in some cases, each gap member is an air gap).

The number of pieces of the core pieces or the gap members can appropriately be selected such that the reactor 1 obtains the desired inductance. Further, the shape of the core pieces or the gap members can appropriately be selected. Here, though the description is given of the mode in which each inner core portion 31 includes a plurality of core pieces 31*m* and a plurality of gap members 31*g*, the gap member may be provided by one in number. Further, depending on the material of the core pieces, the gap members can be dispensed with. Still further, though the description is given of the mode in which each outer core portion 32 is structured by a single core piece, the outer core portion 32 may be structured by a plurality of core pieces. In the case where the core pieces are structured by powder magnetic cores, employing the mode in which a plurality of core pieces structure the inner core portions and the outer core portions, each of the core pieces can be reduced in size. Therefore, excellent moldability is achieved.

In addition, employing the structure in which a coating layer made of an insulating material is provided at the outer circumference of each inner core portion 31, insulation between the coil 2 and the inner core portion 31 can be enhanced. The coating layer may be provided by, for example, disposing a heat shrink tubing or a cold shrink tubing, an insulating tape or an insulating paper or the like. By disposing the shrink tubing at the outer circumference of each inner core portion 31 or bonding the insulating tape thereto, integration of the core pieces and the gap members can be achieved, in addition to an improvement in insulation.

In connection with the magnetic core 3, the faces of the inner core portions 31 on the installation side and the faces of the outer core portions 32 on the installation side are not flush with each other. Specifically, as shown in FIG. 5, when the reactor 1 is installed in the fixation target, the faces of the outer core portions 32 on the installation side (hereinafter referred to as the core installation faces 32*d*; the bottom faces in FIGS. 3 and 5) project further than the faces of the inner core portions 31 on the installation side. Here, the height of the outer core portions 32 (the length in the direction perpendicular to the surface of the fixation target in the state where the reactor 1 is installed in the fixation target (here, the direction being perpendicular to the axial direction of the coil 2; the top-bottom direction in FIGS. 3 and 5)) is adjusted such that the core installation faces 32*d* of the outer core portions 32 and the face of the coil 2 on the installation side (hereinafter referred to as the coil installation face 2*d*; the bottom faces in FIGS. 3 and 5) become flush with each other, and the faces (the top faces in FIGS. 3 and 5) opposing to the installation side of the inner core portions 31 and the faces (the top faces in FIGS. 3 and 5) of the outer core portions 32 opposing to the coil installation faces 32*d* become flush with each other. Accordingly, when the magnetic core 3 is seen from sideways in the state where the reactor 1 is installed, the magnetic core 3 is in the shape of ] being rotated by 90° in the counterclockwise direction. Further, since the core installation faces 32*d* and the coil installation face 2*d* are flush with each other, not only the coil installation face 2d of the coil 2, but also the core installation face 32*d* of the outer core portion 32 can be brought into contact with the heat dissipation layer 42 (FIG. 2), which will be described later. Further, in the state where the magnetic core 3 is assembled in an annular shape, the side faces of the outer core portions 32 (the faces on the near and depth sides in FIG. 3) project outward than the side faces of the inner core portions 31. Accordingly, in the state where the reactor is installed (i.e., in the state where the bottom side is the installation side in FIG. 3), the magnetic core 3 is H-shaped as seen from the top face or the bottom face. By structuring the magnetic core 3 having such a three-dimensional shape as the powder magnetic core, its shape is easily formed, and the portion in the outer core portions 32 projecting further than the inner core portions 31 can also be used as the path of the magnetic flux. Further, by the core installation faces 32*d* and the coil installation face 2*d* being flush with each other, the combined product 10 can stably be installed.

[Insulator]

Figure 4:
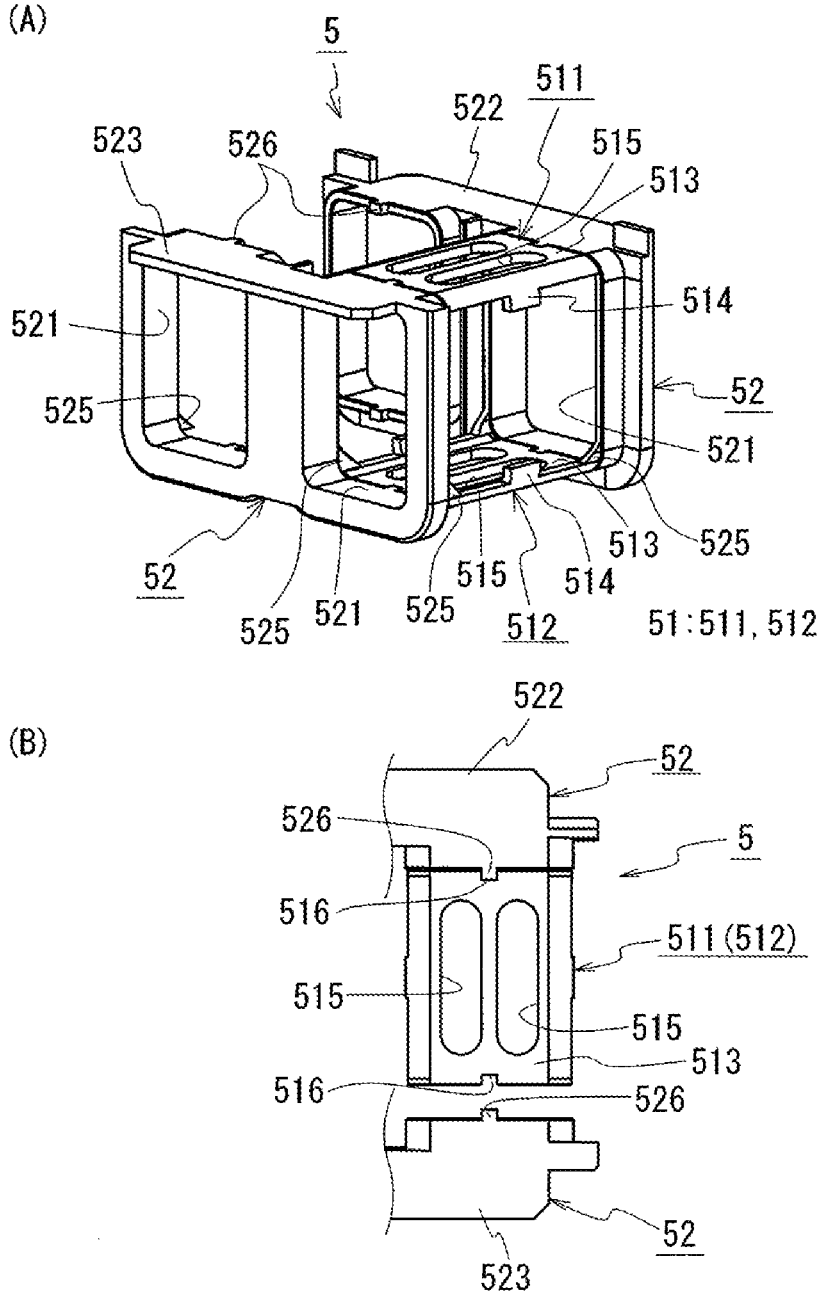
[FIG. 4] FIG. 4 (A) is a schematic perspective view of an insulator included in the reactor according to the embodiment.
Figure 5:
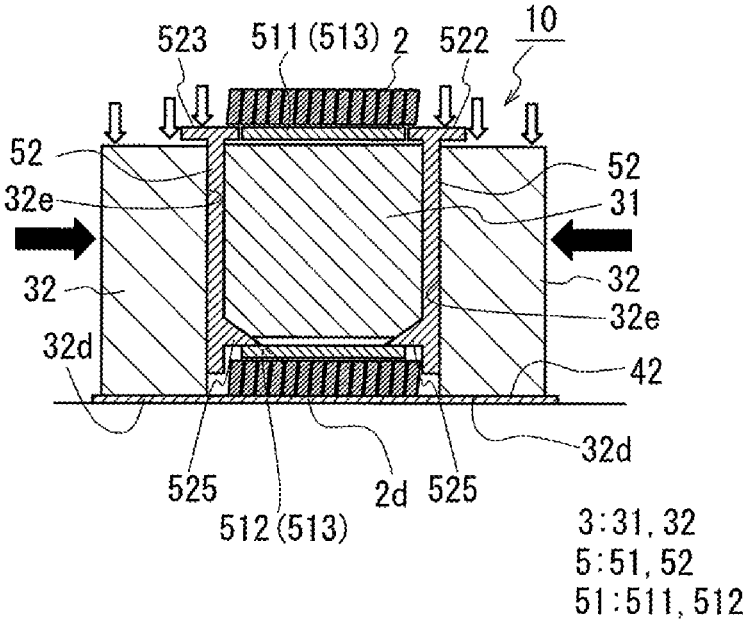
[FIG. 5]

With reference to FIGS. 3 to 5 as appropriate, a description will be given of the insulator. The combined product 10 includes the insulator 5 between the coil 2 and the magnetic core 3, to enhance insulation between the coil 2 and the magnetic core 3. The insulator 5 may be structured to include a surrounding wall portion 51 disposed on the outer circumference of the inner core portions 31, and a pair of frame-like portions 52 abutting on the end faces (i.e., the faces where the turn of each coil element is shown in an annular manner) of the coil 2. Note that, for the sake of clarity, in FIG. 4 (A), the surrounding wall portion 51 disposed at one inner core portion is not shown, and in FIG. 4 (B), solely one surrounding wall portion 51 and its surroundings are shown.

The surrounding wall portion 51 is interposed between the inner circumferential face of the coil 2 and the outer circumferential face of the inner core portions 31, to thereby insulate the coil 2 and the inner core portions 31 from each other. Here, the surrounding wall portion 51 is structured by a pair of divided pieces 511 and 512. The divided pieces 511 and 512 are not in contact with each other, and the divided pieces 511 and 512 are disposed at only part of the outer circumferential face of the inner core portions 31 (herein, mainly the face on the installation side of the inner core portions 31 (i.e., the bottom face in FIG. 5) and the face opposing thereto (i.e., the top face in FIG. 5)). The divided pieces 511 and 512 are each an element whose cross section is ]-shaped and which includes a flat plate portion 513 disposed on each of the installation side of the inner core portion 31 and the face opposing thereto, and a pair of hook portions 514 provided to stand upright from the flat plate portion 513. The hook portions 514 are respectively hooked on the side faces each connecting between the face of the inner core portions 31 on the installation side and the face opposing thereto, in order to allow the flat plate portions 513 to be disposed to face the face of the inner core portions 31 on the installation side and the face opposing thereto. Here, each hook portion 514 is provided not along the entire length of the flat plate portion 513, but is provided along the partial length. However, so long as the hook portions 514 can be hooked on the rectangular parallelepiped-shaped inner core portions 31, the shape and size thereof are not limited. Further, here, the divided pieces 511 and 512 are each provided with a window portion 515 penetrating through the front and back surfaces of the flat plate portion 513. Note that, though the surrounding wall portion 51 may be formed as a sleeve-like element disposed along the entire circumference of the outer circumferential face of the inner core portions 31 (see FIG. 7 whose description will follow), part of the inner core portions 31 may not be covered by the surrounding wall portion 51 as shown in FIG. 3, so long as the insulating distance between the coil 2 and the inner core portion 31 can be secured.

By the part of the inner core portions 31 being exposed outside the surrounding wall portion 51, the material of the insulator 5 can be reduced. Further, when the mode in which the sealing resin is included is employed, with the structure in which the divided pieces 511 and 512 are each provided with the window portion 515 and not the entire circumference of the inner core portions 31 is covered by the surrounding wall portion 51, the contact area between the inner core portions 31 and the sealing resin can be increased. Furthermore, it facilitates the bubbles to dissipate when the sealing resin is poured. Thus, excellent manufacturability of the reactor 1 can be achieved.

By the inner face of each flat plate portion 513 being in contact with the outer circumferential face of the inner core portions 31, a plurality of core pieces 31*m* being the constituents of the inner core portions 31 can be aligned on the identical plane. In particular, since the insulator 5 is provided with a pressing mechanism, which will be described later, a plurality of core pieces 31*m* structuring the face of the installation side of the inner core portion 31 can be aligned by the inner face of the flat plate portion 513 of the divided piece 512, the divided piece 512 being the surrounding wall portion 51 disposed on the installation side. Further, by the outer face of the flat plate portion 513 of the divided piece 512 being in contact with the inner circumferential face of the coil 2, the turns of the coil 2 can be aligned on an identical plane, as will be described later. In the following, the flat plate portion 513 of the divided piece 512 is referred to as the installation face portion.

Each of the frame-like portions 52 is interposed between the end face of the coil 2 and the inner end face 32*e* of corresponding outer core portion 32, to insulate the coil 2 and the outer core portion 32 from each other. Each frame-like portion 52 has a flat plate-like body portion. The body portion is provided with a pair of opening portions 521 into which the inner core portions 31 are respectively inserted. Here, in order to facilitate introduction of the inner core portions 31, short sleeve-like portions that continue from the opening portions 521 of the body portion to project toward the inner core portions 31 are provided. Further, one frame-like portion 52 is provided with a pedestal 522 for placing the coil couple portion 2*r* and for insulating the coil couple portion 2*r* and the outer core portion 32 from each other. The pedestal 522 is a plate piece which overhangs so as to be brought into contact with the face (the top face in FIG. 5) opposing to the core installation face 32*d* of the outer core portion 32. The pedestal 522 also serves as the portion with which the pressing member (not shown) is directly in contact, when the surrounding wall portion 51 is pressed during manufacture of the reactor 1, as will be described later. The protruding portion 523 functioning as the contact portion of the pressing member is similarly provided to the other frame-like portion 52. Provision of the protruding portion 523 facilitates pressing performed by the pressing member. However, since a certain thickness of the frame-like portion 52 further aids in pressing against the pressing member, the protruding portion 523 can be dispensed with.

The insulator 5 has engaging portions where the surrounding wall portion 51 and the frame-like portion 52 engage with each other. Here, an engaging concave portion 516 is provided at the place where the flat plate portion 513 of each of the divided pieces 511 and 512 is brought into contact with the frame-like portion 52 when the insulator 5 is assembled as shown in FIG. 4(A), and an engaging convex portion 526 is provided at the place where each sleeve-like portion of the frame-like portion 52 is brought into contact with the flat plate portion 513. Here, the engaging concave portion 516 is designed as a quadrangular groove and the engaging convex portion 526 is designed as a quadrangular piece, both being in simple shapes. The shape of the engaging portions is not particularly limited so long as the surrounding wall portion 51 and the frame-like portions 52 can position each other. The engaging portions are not required to be so complicated that they are hardly separated from each other once the surrounding wall portion 51 and the frame-like portions 52 engage with each other. As shown in the embodiment, the engaging portions can be of any shape, being easily separated from each other when being just engaged with each other, e.g., a polygonal shape such as triangular, or a curved shape such as semi-arc shape. Further, the concave shape and the convex shape respectively provided to the surrounding wall portion 51 and the frame-like portions 52 may be inverted. In addition, in the state where the engaging concave portion 516 and the engaging convex portion 526 engage to each other, a certain degree of clearance is allowed to exist between them.

Further, one of the characteristics of the insulator 5 is provision of the pressing mechanism which presses the flat plate portion 513 (the installation face portion) of the divided piece 512 disposed on the installation side in the surrounding wall portion 51 as described above against the inner circumferential face of the coil 2, in order to bring particularly the coil installation face 2*d* in the outer circumferential face of the coil 2 into contact evenly with a heat dissipation layer 42, which will be described later. Specifically, each frame-like portion 52 has projecting portions 525 which press the installation face portion against the inner circumferential face of the coil 2 when being combined with the surrounding wall portion 51. Thus, a pressing function is structured by the engaging portions and the projecting portions 525. The pressing function will be detailed later in connection with the manufacturing process of the reactor 1.

Here, the projecting portions 525 are each a triangular small piece projecting toward the surrounding wall portion 51 from the portion near the corresponding corner on the installation side (the bottom side in FIGS. 3 to 5) of the sleeve-like portion of the frame-like portion 52, in the state where the insulator 5 is assembled. Then, in the state where the insulator 5 is assembled, as shown in FIG. 5, one side of the small piece is brought into contact with the flat plate portion 513 (installation face portion) of the divided piece 512 so as to press the installation face portion against the inner circumferential face of the coil 2. The shape of each projecting portion 525 is not particularly limited so long as it is capable of evenly press the installation face portion against the inner circumference of the coil 2. Each projecting portion 525 may not be triangular as described above, and it may be quadrangular. Further, the structure in the present embodiment is as follows: the projecting portion 525 is provided to each of the portions near the two corners on the installation side of the frame-like portion 52, that is, a single installation face portion is pressed by four projecting portions 525. For example, though the structure in which two projecting portions are provided on a diagonal line can be employed, provision of four projecting portions as described above makes it possible for a single installation face portion to be pressed stably and evenly.

As the material of the insulator 5, an insulating material such as polyphenylene sulfide (PPS) resin, polytetrafluoroethylene (PTFE) resin, polybutylene terephthalate (PBT) resin, liquid crystal polymer (LCP) and the like can be used.

<<Case>>

Figure 2:
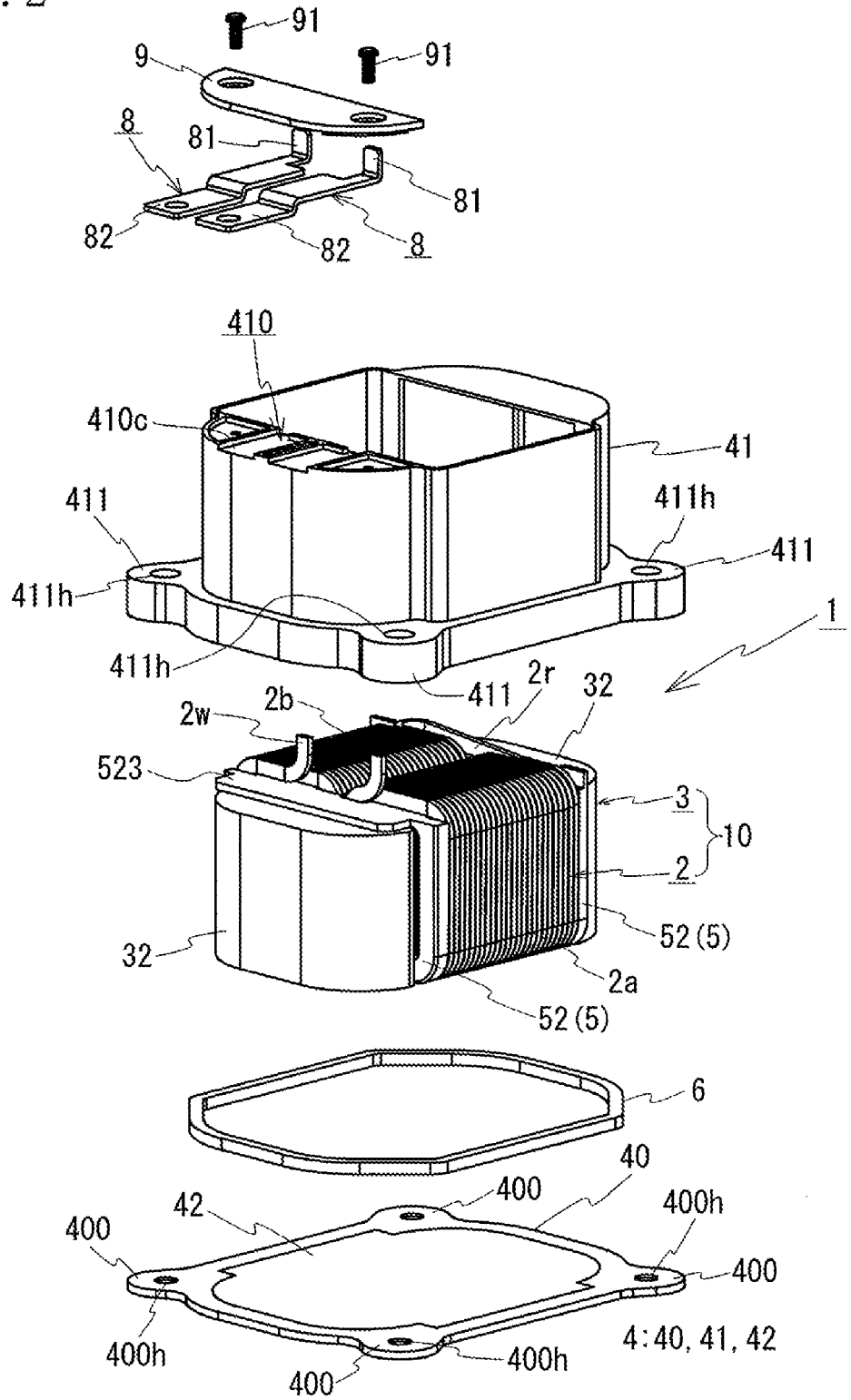
[FIG. 2]

With reference to FIG. 2 as appropriate, a description will be given of the case 4. The case 4 storing the combined product 10 made up of the coil 2 and the magnetic core 3 includes a flat plate-like bottom plate portion 40 and a frame-like side wall portion 41 provided to stand upright from the bottom plate portion 40. Some of the characteristics of the reactor 1 are as follows: the bottom plate portion 40 and the side wall portion 41 are not integrally molded, and are fixed by fixation members; and the bottom plate portion 40 is provided with the heat dissipation layer 42.

[Bottom Plate Portion and Side Wall Portion]

(Bottom Plate Portion)

The bottom plate portion 40 is a quadrangular plate, and is fixed to a fixation target when the reactor 1 is installed in the fixation target. Though the example in FIG. 2 shows the installation state where the bottom plate portion 40 is on the bottom side, in another possible installation state, the bottom plate portion 40 may be positioned on the top side or oriented sideways. The bottom plate portion 40 is provided with the heat dissipation layer 42 at one face, which is located inside when the case 4 is assembled. The outer shape of the bottom plate portion 40 can appropriately be selected. Here, the bottom plate portion 40 has attaching portions 400 respectively projecting from the four corners. The outer shape of the bottom plate portion 40 is designed to conform to the outer shape of the side wall portion 41, which will be described later. When the bottom plate portion 40 and the side wall portion 41 are combined to form the case 4, the attaching portions 400 overlap with attaching portions 411 of the side wall portion 41. Alternatively, it is also possible to employ the outer shape in which the side wall portion 41 is provided with no attaching portions 411, and the attaching portions 400 of the bottom plate portion 40 project from the outer shape of the side wall portion 41. The attaching portions 400 are each provided with a bolt hole 400*h* through which a bolt (not shown) for fixing the case 4 to the fixation target is inserted. The bolt holes 400*h* are provided so as to be continuous to bolt holes 411*h*, which will be described later, of the side wall portion 41. The bolt holes 400*h* and 411*h* may each be a through hole not being threaded or may be a screw hole being threaded. The number of pieces of the bolt holes 400*h* and 411*h* can arbitrarily be selected.

(Side Wall Portion)

The side wall portion 41 is a quadrangular frame-like element. The side wall portion 41 is disposed to surround the combined product 10 when the case 4 is assembled, while having its one opening portion closed by the bottom plate portion 40 and the other opening portion being opened. Here, in connection with the side wall portion 41, when the reactor 1 is disposed at the fixation target, the region becoming the installation side is quadrangular conforming to the outer shape of the bottom plate portion 40, and the region on the opening side is in a curved plane shape conforming to the outer circumferential face of the combined product 10 made up of the coil 2 and the magnetic core 3. In the state where the case 4 is assembled, the outer circumferential face of the coil 2 and the inner circumferential face of the side wall portion 41 are in close proximity to each other. The interval between the outer circumferential face of the coil 2 and the inner circumferential face of the side wall portion 41 is very narrow, i.e., about 0 mm to 1.0 mm. Further, in the present embodiment, on the region on the opening side of the side wall portion 41, an overhanging portion is provided so as to cover the trapezoidal face of the outer core portion 32 of the combined product 10. In connection with the combined product 10 stored in the case 4, as shown in FIG. 1, the coil 2 is exposed, and the magnetic core 3 is substantially covered by the constituents of the case 4. Provision of the overhanging portion realizes an improvement in resistance to vibration and in rigidity of the case 4 (side wall portion 41). Furthermore, mechanical protection and protection from the external environment for the combined product 10 is obtained. Note that, one trapezoidal face of each of the outer core portion 32 may be exposed together with the coil 2, by omitting the overhanging portion.

[Terminal Block]

In the region on the opening side of the side wall portion 41, the portion covering above the one outer core portion 32 functions as a terminal block 410 at which the terminal hardware 8 is fixed.

The terminal hardware 8 is a rectangular plate member including a welding face 81 to be connected to the end portion of the wire 2*w* structuring the coil 2, a connecting face 82 to be connected to an external apparatus such as a power supply, and a coupling portion connecting between the welding face 81 and the connecting face 82. The terminal hardware 8 is bent in an appropriate shape as shown in FIG. 2. In order to connect between the conductor portion of the wire 2*w* and the terminal hardware 8, welding such as TIG welding or press-fitting can be used. The shape of the terminal hardware 8 is merely an example, and any appropriate shape can be employed.

In the terminal block 410, concave grooves 410*c* where the coupling portion of the terminal hardware 8 is disposed are formed. The terminal hardware 8 fitted into the concave grooves 410*c* has its top portion covered by a terminal fixing member 9. The terminal fixing member 9 is fixed to the terminal block 410 by being tightened by bolts 91. As the material of the terminal fixing member 9, an insulating material such as an insulating resin used as the material of the case, which will be described later, can suitably be used. Note that, it is also possible to employ the mode in which the terminal block is structured as a separate member, and the terminal block is separately fixed to the side wall portion, for example. Further, in the case where the side wall portion is formed by an insulating material, which will be described later, by forming the terminal hardware by insert molding, it is also possible to employ the mode in which the side wall portion, the terminal hardware, and the terminal block portion are integrated.

[Attaching Place]

The region on the installation side of the side wall portion 41 is provided with attaching portions 411 respectively projecting from the four corners, similarly to the bottom plate portion 40. The attaching portions 411 are each provided with the bolt hole 411*h*. The bolt hole 411*h* may be formed solely by the material of the side wall portion 41, or may be formed by disposing a tubular element made of a different material thereto. For example, in the case where the side wall portion 41 is structured by resin, employing a metal pipe made of, for example, metal such as brass, steel, or stainless steel as the tubular element, excellent strength is exhibited, and hence creep deformation of the resin can be suppressed. Here, a metal pipe is disposed to form each bolt hole 411*h*.

(Material)

In the case where the material of the case 4 is a metal material, for example, since the metal material is generally high in thermal conductivity, a case possessing an excellent heat dissipating characteristic can be obtained. Specific metal may include, for example, aluminum and aluminum alloy, magnesium (thermal conductivity: 156 W/m·K) and magnesium alloy, copper (390 W/m·K) and copper alloy, silver (427 W/m·K) and silver alloy, iron, austenitic stainless steel (for example, SUS304: 16.7 W/m·K) and the like. Using such aluminum, magnesium, and alloy thereof, the lightweight case can be obtained. Thus, it becomes possible to contribute toward reducing the weight of the reactor. In particular, since aluminum and aluminum alloy exhibit excellent corrosion resistance also, they can suitably be used for in-vehicle components. In the case where the case 4 is formed by any metal material, it can be achieved by casting such as die casting, and plastic working such as press working.

Alternatively, in the case where non-metallic materials such as resin, e.g., polybutylene terephthalate (PBT) resin, urethane resin, polyphenylene sulfide (PPS) resin, and acrylonitrile butadiene styrene (ABS) resin are used as the material of the case 4, since such non-metallic materials generally possess an excellent electrical insulating characteristic, the insulation between the coil 2 and the case 4 can be enhanced. Further, since these non-metallic materials are lighter than the metal materials noted above, a reduction in weight of the reactor 1 can be achieved. Employing the mode in which filler made of ceramic, which will be described later, is added to the resin noted above, the heat dissipating characteristic can be improved. In the case where the case 4 is formed by resin, injection molding can suitably be used.

The material of the bottom plate portion 40 and that of the side wall portion 41 can be of the similar type. In this case, the bottom plate portion 40 and the side wall portion 41 becomes equivalent in thermal conductivity. Alternatively, since the bottom plate portion 40 and the side wall portion 41 are structured as separate members, they may be made of different materials. In this case, particularly, by selecting the materials such that the bottom plate portion 40 becomes greater in thermal conductivity than the side wall portion 41, heat from the coil 2 and the magnetic core 3 disposed on the bottom plate portion 40 can efficiently be dissipated to the fixation target such as a cooling base. Here, the bottom plate portion 40 is made of aluminum, while the side wall portion 41 is made of PBT resin.

(Coupling Method)

In the scheme of integrally connecting the bottom plate portion 40 and the side wall portion 41 to each other, various fixation members can be used. The fixation members may include, for example, tightening members such as an adhesive agent and bolts. Here, the bottom plate portion 40 and the side wall portion 41 are provided with bolt holes (not shown), and bolts (not shown) are employed as the fixation members. By screwing the bolts, the bottom plate portion 40 and the side wall portion 41 are integrated.

[Heat Dissipation Layer]

The bottom plate portion 40 is provided with the heat dissipation layer 42 at the portion being brought into contact with the coil installation face 2*d* of the coil 2 (FIG. 5) and the core installation faces 32*d* of the outer core portions 32 (FIG. 5). The heat dissipation layer 42 is made of an insulating material whose thermal conductivity is higher than 2 W/m·K. Preferably, the thermal conductivity of the heat dissipation layer 42 is as high as possible, i.e., preferably, 3 W/m·K or more, particularly preferably 10 W/m·K or more, still more preferably 20 W/m·K or more, and even more preferably 30 W/m·K or more.

The specific material of the heat dissipation layer 42 may include, for example, a non-metallic inorganic material such as ceramic, being one type of material selected from oxide, carbide, and nitride of metallic element, B, and Si. More specific ceramic may be, silicon nitride ($Si_3N_4$): approx. 20 W/m·K to 150 W/m·K; alumina ($Al_2O_3$): approx. 20 W/m·K to 30 W/m·K; aluminum nitride (AlN): approx. 200 W/m·K to 250 W/m·K; boron nitride (BN): approx. 50 W/m·K to 65 W/m·K; and silicon carbide (SiC): approx. 50 W/m·K to 130

W/m·K. These types of ceramic possess an excellent heat dissipating characteristic, and even more, they also possess an excellent electrical insulating characteristic also. In the case where the heat dissipation layer 42 is formed by these types of ceramic, for example, deposition such as PVD or CVD can be used. Alternatively, the heat dissipation layer 42 can be formed by preparing a sintered plate of the ceramic noted above, and bonding the same to the bottom plate portion 40 by any appropriate adhesive agent.

Alternatively, the material of the heat dissipation layer 42 may be an insulating resin containing a filler made of the ceramic noted above. The insulating resin may include, for example, epoxy resin, acrylic resin and the like. Since the insulating resin includes the filler possessing an excellent heat dissipating characteristic and an electrical insulating characteristic, the heat dissipation layer 42 possessing an excellent heat dissipating characteristic and an electrical insulating characteristic can be structured. Further, in the case where resin containing a filler is used also, by applying the resin to the bottom plate portion 40 or the like, the heat dissipation layer 42 can easily be formed. In the case where the heat dissipation layer 42 is made of an insulating resin, particularly, use of an adhesive agent is preferable because the adhesion between the coil 2 and the heat dissipation layer 42 can be enhanced. In the case where the heat dissipation layer 42 is formed by the insulating resin, for example, it can be formed with ease through use of screen printing.

Here, the heat dissipation layer 42 is formed by an epoxy base adhesive agent containing a filler made of alumina (thermal conductivity: 3 W/m·K). Further, here, the heat dissipation layer 42 is formed as a two-layer structure of the adhesive agent layer, in which the thickness per layer is 0.2 mm, i.e., 0.4 mm in total. The heat dissipation layer 42 may be structured by three or more layers. Further, in the case where such a multilayer structure is employed, the material of at least one layer may be different from that of the other layers. For example, in the heat dissipation layer 42, the layer being in contact with the coil 2 and the bottom plate portion 40 may possess a higher adhesion characteristic, while the other layers may possess a higher heat dissipating characteristic. The shape of the heat dissipation layer 42 is not particularly limited so long as the coil installation face 2*d* and the core installation faces 32*d* have the area which is enough to be brought into contact with the heat dissipation layer 42. Herein, as shown in FIG. 2, the heat dissipation layer 42 is in the shape conforming to the shape formed by the coil installation face 2*d* of the coil 2 and the core installation face 32*d* of the outer core portion 32.

[Sealing Resin]

It is possible to employ the mode in which the case 4 is filled with sealing resin (not shown) being an insulating resin. In this case, the end portions of the wire 2*w* are drawn outside the case 4, to be exposed outside the sealing resin. The exemplary sealing resin may be epoxy resin, urethane resin, silicone resin and the like. Further, allowing the sealing resin to contain the filler possessing an excellent insulating characteristic and thermal conductivity, for example, the filler made of at least one type of ceramic selected from silicon nitride, alumina, aluminum nitride, boron nitride, mullite, and silicon carbide, the heat dissipating characteristic can further be enhanced.

In the case where the case 4 is filled with a sealing resin, a gasket 6 may be provided in order to prevent uncured resin from leaking from the clearance between the bottom plate portion 40 and the side wall portion 41. Here, the gasket 6 is an annular element of the dimension with which the gasket 6 can be fitted to the outer circumference of the combined product 10 made up of the coil 2 and the magnetic core 3. Though the gasket 6 made of synthetic rubber is employed, the gasket made of any appropriate material can be used. On the installation side of the side wall portion 41 of the case 4, a gasket groove (not shown) in which the gasket 6 is disposed is provided.

<<Manufacture of Reactor>>

The reactor 1 structured as described above can be manufactured in the following manner.

First, the combined product 10 made up of the coil 2 and the magnetic core 3 is formed. Specifically, as shown in FIG. 3 (B), the inner core portions 31 are formed by laminating the core pieces 31*m* and the gap members 31*g*. In the state where the surrounding wall portion 51 (divided pieces 511 and 512) of the insulator 5 is disposed at the outer circumference of the inner core portions 31, the inner core portions 31 are respectively inserted into the coil elements 2*a* and 2*b*. At this time, since the surrounding wall portion 51 is provided with the hook portions 514, the surrounding wall portion 51 can easily be disposed on the face of the inner core portion 31 on the installation side and the face opposing thereto. The combined product 10 is formed by disposing the frame-like portions 52 and the outer core portions 32 to the coil 2, such that the end faces of the coil elements 2*a* and 2*b* and the end faces 31*e* of the inner core portions 31 are interposed between the frame-like portions 52 of the insulator 5 and the inner end faces 32*e* of the outer core portions 32. At this time, the end faces 31*e* of the inner core portions 31 are exposed outside the opening portions of the frame-like portions 52 and are brought into contact with the inner end faces 32*e* of the outer core portions 32. In forming the combined product 10, the sleeve-like portions of the frame-like portions 52 can be used as a guide. Further, by allowing the engaging concave portion 516 of the surrounding wall portion 51 and the engaging convex portion 526 of the frame-like portion 52 to engage with each other, the relative position between the surrounding wall portion 51 and the frame-like portions 52 can be adjusted as appropriate.

The core pieces 31*m* and the gap members 31*g* can be integrated by, for example, applying an adhesive agent or winding around an adhesion tape, so as to be joined. Here, the mode not using an adhesive agent is employed. Further, though the paired divided pieces 511 and 512 structuring the surrounding wall portion 51 are not structured to engage with each other, as described above, they are engaged with the frame-like portions 52 and are inserted into the coil elements 2*a* and 2*b* with the inner core portions 31, and further the outer core portions 32 are arranged. Thus, the state in which the paired divided pieces 511 and 512 are disposed between the inner circumferential faces of the coil elements 2*a* and 2*b* and the inner core portions 31 is maintained and the paired divided pieces 511 and 512 will not come off.

On the other hand, as shown in FIG. 2, an aluminum plate is punched out into a prescribed shape to form the bottom plate portion 40. On one face of the bottom plate portion 40, the heat dissipation layer 42 of a prescribed shape is formed by screen printing. A combined product 10 assembled as described above is bonded and fixed onto the heat dissipation layer 42.

More specifically, as shown in FIG. 5, the outer core portions 32 are retained so as to clamp the inner core portions 31 of the combined product 10. Further, the face (the top face in FIG. 5) of the outer core portions 32 opposing to the core installation face 32*d*, and the pedestal 522 and the protruding portion 523 of the frame-like portions 52 of the insulator 5 are pressed against the heat dissipation layer 42 (i.e., downward in FIG. 5) as indicated by outline arrows. By pressing the pedestal 522 and the protruding portion 523, the projecting portions 525 of the frame-like portions 52 press the flat plate portion 513 (installation face portion) of the divided piece 512 on the installation side against the heat dissipation layer 42. At this time, since the engaging portions fix the position of the surrounding wall portion 51 and the frame-like portions 52, the installation face portion is evenly pressed against the heat dissipation layer 42. By the installation face portion, the inner circumferential face of the coil 2 is also pressed evenly. In order to carry out the pressing, any appropriate pressing member (not shown) can be used. The pressing force must be kept in the range with which the magnetic core 3, the insulator 5, the insulating coat of the coil 2, and the heat dissipation layer 42 are not damaged. Further, as shown in FIG. 5, the size of the frame-like portions 52 and that of the opening portions is adjusted such that a slight clearance is provided between the installation side portion of the frame-like portions 52 of the insulator 5 and the heat dissipation layer 42, while the frame-like portions 52 are each interposed between corresponding end face of the coil 2 and the inner end face 32*e* of corresponding outer core portion 32. Thus, when the frame-like portions 52 are pressed against the heat dissipation layer 42 as described above, until the pedestal 522 and the protruding portion 523 are brought into contact with the faces of the outer core portions 32 opposing to the core installation faces 32*d*, the frame-like portions 52 can secure enough allowance for shifting.

As described above, since the inner circumferential face of the coil 2 is evenly pressed, that is, so as to form a flat plane, the turns particularly structuring the coil installation face 2*d* in the outer circumferential face of the coil 2 are aligned. As a result, any shape error which is produced while the coil 2 is wound is corrected, and the coil installation face 2*d* can easily become a smooth plane. For example, if the dimension error of the wire 2*w* is at a minimum value, then the external dimension of the coil 2 is substantially identical to the design dimension. Therefore, the coil installation face 2*d* is structured substantially by a flat plane, becoming substantially flush with the core installation faces 32*d* of the outer core portions 32. On the other hand, when the dimension error of the wire 2*w* is at a maximum value, the coil installation face 2*d* of the coil 2 becomes uneven by the amount of the error. This may result in a production of a portion projecting further than the core installation faces 32*d* of the outer core portions 32. However, by selecting the wire 2*w* taking into consideration of the dimension error of the thickness of the insulating coat such that the projection amount becomes less than the thickness of the heat dissipation layer 42, it becomes possible to cause such a projecting portion to be buried in the heat dissipation layer 42 made of an adhesive agent when being pressed as described above. That is, by structuring the heat dissipation layer 42 by the insulating adhesive agent, the error of the wire 2*w* can be absorbed, though it depends on the thickness thereof. By appropriately selecting the thickness of the insulating coat of the wire 2*w* and the thickness of the heat dissipation layer 42 in this manner, insulation between the coil 2 and the case 4 can fully be secured.

Since the heat dissipation layer 42 is made of an adhesive agent and the coil installation face 2*d* of the coil 2 is pressed against the heat dissipation layer 42 in the state being aligned by the insulator 5, the combined product 10 can strongly be fixed to the bottom plate portion 40. Further, in addition to the coil 2, the outer core portions 32 can also be strongly fixed to the heat dissipation layer 42. The gasket 6 is disposed at the outer circumference of the combined product 10.

Note that, in forming the combined product 10, an adhesive agent can be used in joining the core pieces 31*m* and the gap members 31*g*. In this case, for example, the core pieces 31*m* and the gap members 31*g* to which an adhesive agent is applied are stacked, to assemble the inner core portions 31. Thereafter, as described above, the surrounding wall portion 51 and the coil 2 are disposed. The frame-like portions 52 are disposed between the coil 2 and the outer core portions 32 as described above. The end faces 31*e* of the inner core portions 31 to which an adhesive agent is applied and the inner end faces 32*e* of the outer core portions 32 are brought into contact with each other, to form the combined product 10. Then, the coil installation face should be smoothed using the fixing jig 100 shown in FIG. 6 for example, and the adhesive agent should be cured.

Figure 6:
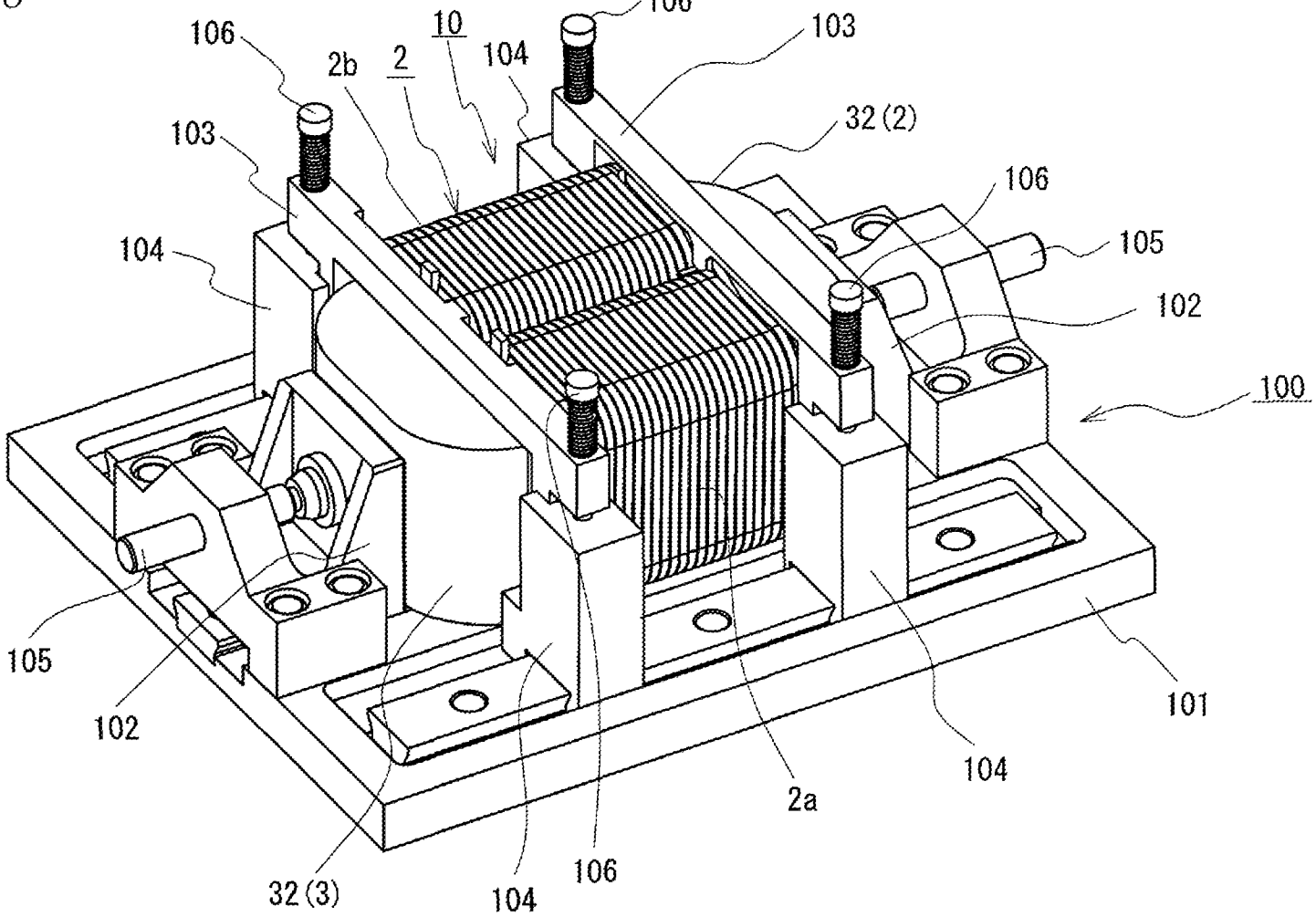
[FIG. 6]

The fixing jig 100 shown in FIG. 6 includes: a plate-like body 101 on which the combined product 10 is placed; a pair of core pressing portions 102 slidably disposed at the body 101, the core pressing portions 102 being opposed to each other so as to clamp the outer core portions 32 of the combined product 10; a pair of insulator pressing portions 103 pressing the frame-like portions of the insulator; and support portions 104 slidably supporting the insulator pressing portions 103 relative to the body 101. The core pressing portions 102 are each coupled to the body 101 by a bolt 105. When the bolts 105 are tightened, the core pressing portions 102 slide so as to approach toward each other. Thus, the core pressing portions 102 can press the outer core portions 32 in the direction approaching toward each other. The insulator pressing portions 103 are each a plate piece disposed along the corresponding frame-like portion. The insulator pressing portions 103 are disposed across the pair of support portions 104, which are disposed to clamp the pair of coil elements 2*a* and 2*b*. The insulator pressing portions 103 are coupled by bolts 106 to the support portions 104. Further, by the bolts 106 being tightened, the insulator pressing portions 103 can press the frame-like portions toward the body 101 (i.e., downward in FIG. 6).

According to the manner described above, the combined product 10 obtained by assembling the coil 2 and the magnetic core 3 is placed on the body 101, and the core pressing portions 102 are caused to slide such that the combined product 10 is clamped by the core pressing portions 102. Further, the support portions 104 are caused to slide such that the insulator pressing portions 103 are disposed at the positions of the frame-like portion of the combined product 10. Then, the bolts 105 are tightened such that the core pressing portions 102 press the outer core portions 32. Further, the bolts 106 are tightened such that the insulator pressing portions 103 press the frame-like portion. By the outer core portions 32 being pressed, the thickness of the adhesive agent becomes even with ease. Further, by the frame-like portion being pressed, the coil installation face which is smooth and with small unevenness can be obtained. Still further, it becomes possible to cause the coil installation face and the core installation face of the outer core portion 32 to be flush with each other. The adhesive agent should be cured in this state. Thus, the combined product 10 integrated by the adhesive agent with the smooth coil installation face can be formed. By causing the combined product 10 to be brought into contact with the heat dissipation layer, similarly to the foregoing case in which no adhesive agent is used, the combined product 10 (particularly the coil 2) can strongly be fixed to the heat dissipation layer.

On the other hand, the side wall portion 41 formed into a prescribed shape by injection molding or the like covers, from above, the combined product 10 so as to cover the outer circumferential face of the combined product 10, and the bottom plate portion 40 and the side wall portion 41 are integrated by separately prepared bolts (not shown). At this time, the combined product 10 is prevented from coming off from the side wall portion 41 when the side wall portion 41 is positioned relative to the combined product 10 or when the reactor 1 is installed having the bottom plate portion 40 oriented upward or sideways, by the terminal block 410 and the overhanging portion covering one trapezoidal face of each outer core portion 32 serving as abutment stopper. It is also possible to separately provide position fixing portions at the terminal block 410 or in the overhanging portion, to prevent the outer core portion 32 from coming off. Through this process, the box-shaped case 4 as shown in FIG. 1 is assembled, and the state where the combined product 10 is stored in the case 4 can be achieved.

To each of the end portions of the wire 2*w* projecting from the case 4, the welding face 81 of each terminal hardware 8 is welded, and the terminal hardware 8 is buried in each of the concave grooves 410*c* (FIG. 2) of the terminal block 410 (FIG. 2) of the side wall portion 41. Then, the coupling portion of each terminal hardware 8 is covered by the terminal fixing member 9, and the terminal fixing member 9 is fixed to the side wall portion 41 by the bolt 91. Thus, the terminal hardware 8 is fixed to the terminal block 410. Through this process, the reactor 1 provided with no sealing resin is formed.

On the other hand, by allowing the case 4 to be filled with the sealing resin (not shown) and curing the sealing resin, the reactor 1 provided with the sealing resin is formed. Note that it is also possible that: the terminal hardware 8 is previously fixed to the terminal block 410 by the bolts 91; then the case 4 is filled with the sealing resin; and thereafter the end portions of the wire 2*w* and the welding faces 81 of the terminal hardware 8 are welded.

<<Application>>

The reactor 1 structured as described above is suitably used for applications in which the energizing conditions are, for example: the maximum current (direct current) is approx. 100 A to 1000 A; the average voltage is approx. 100 V to 1000 V; and the working frequency is approx. 5 kHz to 100 kHz. Representatively, the reactor 1 is suitably used as a constituent component of an in-vehicle power converter apparatus such as an electric vehicle or a hybrid vehicle.

<<Effect>>

Since the reactor 1 structured as described above has the heat dissipation layer 42 exhibiting excellent thermal conductivity, i.e., the thermal conductivity higher than 2 W/m·K, the heat dissipation layer 42 being interposed between the bottom plate portion 40 and the coil 2, the heat of the coil 2 and that of the magnetic core 3 generated during operation can efficiently be dissipated to the fixation target such as a cooling base via the heat dissipation layer 42. Accordingly, the reactor 1 possesses an excellent heat dissipating characteristic.

In particular, in connection with the reactor 1, the bottom plate portion 40 is made of a material exhibiting excellent thermal conductivity such as aluminum. This also contributes toward dissipating heat from the heat dissipation layer 42 to the fixation target in an efficient manner. Thus, the excellent heat dissipating characteristic can be obtained. Further, in connection with the reactor 1, though the bottom plate portion 40 is made of a metal material (conductive material), since the heat dissipation layer 42 is made of an insulating adhesive agent, the insulation between the coil 2 and the bottom plate portion 40 can be secured even when the heat dissipation layer 42 is extremely thin, i.e., measuring 0.4 mm. In this manner, thanks also to the small thickness of the heat dissipation layer 42, the heat from the coil 2 and the like can easily be transferred to the fixation target via the bottom plate portion 40. Thus, the reactor 1 possesses an excellent heat dissipating characteristic. Further, since the heat dissipation layer 42 is made of an insulating adhesive agent, excellent adhesion between the coil 2 and the magnetic core 3 and the heat dissipation layer 42 can be obtained. This also facilitates transfer of heat from the coil 2 and the like to the heat dissipation layer 42. Thus, the reactor 1 possesses an excellent heat dissipating characteristic.

In addition, the reactor 1 includes the insulator 5 having the pressing function. The pressing function aligns particularly the turns structuring the coil installation face 2*d* in the outer circumferential face of the coil 2. Thus, the contact area of the coil installation face 2*d* with the heat dissipation layer 42 can fully be secured. This also contributes toward efficient dissipation of the heat from the coil 2 to the heat dissipation layer 42, and hence the reactor 1 possesses an excellent heat dissipating characteristic. In particular, use of the coated rectangular wire as the wire 2*w* makes it possible to bring the entire side face portion of the turns structuring the coil installation face 2*d* into contact evenly with the heat dissipation layer 42, and to obtain wide contact area between the coil 2 and the heat dissipation layer 42. In this term also, the reactor 1 has an excellent heat dissipating characteristic. Further, provision of the insulator 5 allows the reactor 1 to enhance the insulation between the coil 2 and the magnetic core 3.

Further, since the reactor 1 includes the case 4, the combined product 10 can be protected from the environment, and can mechanically be protected. Further, despite provision of the case 4, the reactor 1 is lightweight because the side wall portion 41 is made of resin. Even more, since the interval between the outer circumferential face of the coil 2 and the inner circumferential face of the side wall portion 41 can be reduced, the reactor 1 is small in size. Further, thanks also to the thin heat dissipation layer 42 as described above, the interval between the coil installation face 2*d* of the coil 2 and the inner face of the bottom plate portion 40 can be reduced, and hence the reactor 1 is small in size.

Further, since the reactor 1 is integrally structured by having the separate members, i.e., the bottom plate portion 40 and the side wall portion 41, assembled, the heat dissipation layer 42 can be formed at the bottom plate portion 40 in the state where the side wall portion 41 is removed. Accordingly, the heat dissipation layer 42 can easily be formed and hence excellent productivity of the reactor 1 is achieved. Further, in joining the combined product 10 with the bottom plate portion 40 provided with the heat dissipation layer 42, the joining step can similarly be carried out in the state where the side wall portion 41 is removed. Accordingly, the pressing work as described above can be performed with ease, and excellent productivity can be achieved. Further, since the bottom plate portion 40 and the side wall portion 41 are formed as separate members, they can be made of different materials, and hence the materials can be selected from a wider range.

{Variation 1}

Though the description has been given of the mode in which the bottom plate portion and the side wall portion are made of different materials in the embodiment described above, the mode in which the bottom plate portion and the side wall portion are made of the identical material can be employed. For example, when the bottom plate portion and the side wall portion are made of a metal material possessing an excellent heat dissipating characteristic such as aluminum, the heat dissipating characteristic of the reactor can further be enhanced. In particular, in this mode, when a sealing resin is provided, the heat from the coil and the magnetic core can efficiently be transferred to the case. Even more, use of an insulating resin as the sealing resin can enhance insulation between the outer circumferential face of the coil and the inner face of the side wall portion. In this mode also, provision of the heat dissipation layer made of an insulating material can narrower the interval between the coil installation face of the coil and the inner face of the bottom plate portion, and hence a reduction in size is achieved. In this mode, an interval for securing insulation is provided between the outer circumferential face of the coil and the inner face of the side wall portion.

{Variation 2}

Though the description has been given of the mode in which the heat dissipation layer is made of an insulating adhesive agent in the embodiment described above, the mode in which the heat dissipation layer is made of ceramic such as aluminum nitride, alumina or the like can be employed.

{Variation 3}

In the embodiment described above, the description has been given of the mode in which the surrounding wall portion 51 of the insulator 5 is structured by a pair of divided pieces 511 and 512. Alternatively, as an insulator 5α shown in FIG. 7, the surrounding wall portion 51α may be a single sleeve-like element. Here, the insulator 5α will be detailed. The other structures are similar to those in the embodiment described in the foregoing and hence the description thereof will not be repeated.

The insulator 5α includes a pair of sleeve-like surrounding wall portions 51α in which the inner core portions 31 of the magnetic core 3 are stored, and a pair of frame-like portions 52α being in contact with the inner core portions 31 and the outer core portions 32. Similarly to the embodiment described above, the surrounding wall portions 51α and the frame-like portions 52α have engaging portions (fitting concave and convex portions 516α and 526α) engaging with each other. Each surrounding wall portion 51α is a square sleeve-like element which conforms to the outer shape of the inner core portion 31. The installation face side (the depth side in FIG. 7) of the surrounding wall portion 51α is structured to be flat plate-like. This flat plate portion is defined as the installation face portion. Further, on the end portion of the surrounding wall portion 51α, the fitting concave and convex portion 516α to which the fitting concave and convex portion 526α of the frame-like portion 52α is to be fitted is provided. Similarly to the frame-like portion 52 according to the embodiment, each frame-like portion 52α is provided with, at its flat plate-like body portion, a pair of opening portions 521 through which the inner core portions 31 are inserted. In connection with the opening portion 521, on the side being brought into contact with the surrounding wall portion 51α, similarly to the surrounding wall portion 51α, the fitting concave and convex portion 526α is provided; on the side being brought into contact with the outer core portion 32, a ]-shaped frame portion 527 for positioning the outer core portion 32 is provided. Similarly to the insulator 5 according to the embodiment, part of the frame portion 527 functions as the pedestal 522 and the protruding portion 523. In connection with the insulator 5α, the fitting concave and convex portion 516α of the surrounding wall portion 51α and the fitting concave and convex portion 526α of the frame-like portion 52α are fitted to each other, whereby they can retain their respective positions.

Assembly of the combined product using the insulator 5α described above is carried out in the following manner. Firstly, in the state where the inner end face of one outer core portion 32 is oriented upward in FIG. 7, the outer core portion 32 is placed. From the opening side of the frame portion 527, one frame-like portion 52α is slid such that the frame portion 527 is fitted to the outer core portion 32. Through this step, relative to the one frame-like portion 52α, the one outer core portion 32 is positioned.

Next, to the fitting concave and convex portions 526α of the one frame-like portion 52α, the fitting concave and convex portions 516α of each surrounding wall portion 51α are fitted, to attach the pair of surrounding wall portions 51α to the frame-like portion 52α. Through this step, the positional relationship between the one frame-like portion 52α and the surrounding wall portions 51α is retained.

Next, the core pieces **31*m* and the gap members 31*g* are alternately inserted into the surrounding wall portions 51α and stacked therein. The stacked inner core portions 31 have its stacked state retained by the surrounding wall portions 51α. Here, since the surrounding wall portions 51α are in the shape provided with slits opening upward, at a pair of side face portions thereof, the core pieces 31*m* can be held by fingers or the like when the core pieces 31*m* and the gap members 31*g* are inserted into the surrounding wall portions 51α**. Hence, the insertion work can safely and easily be carried out.

Figure 7:
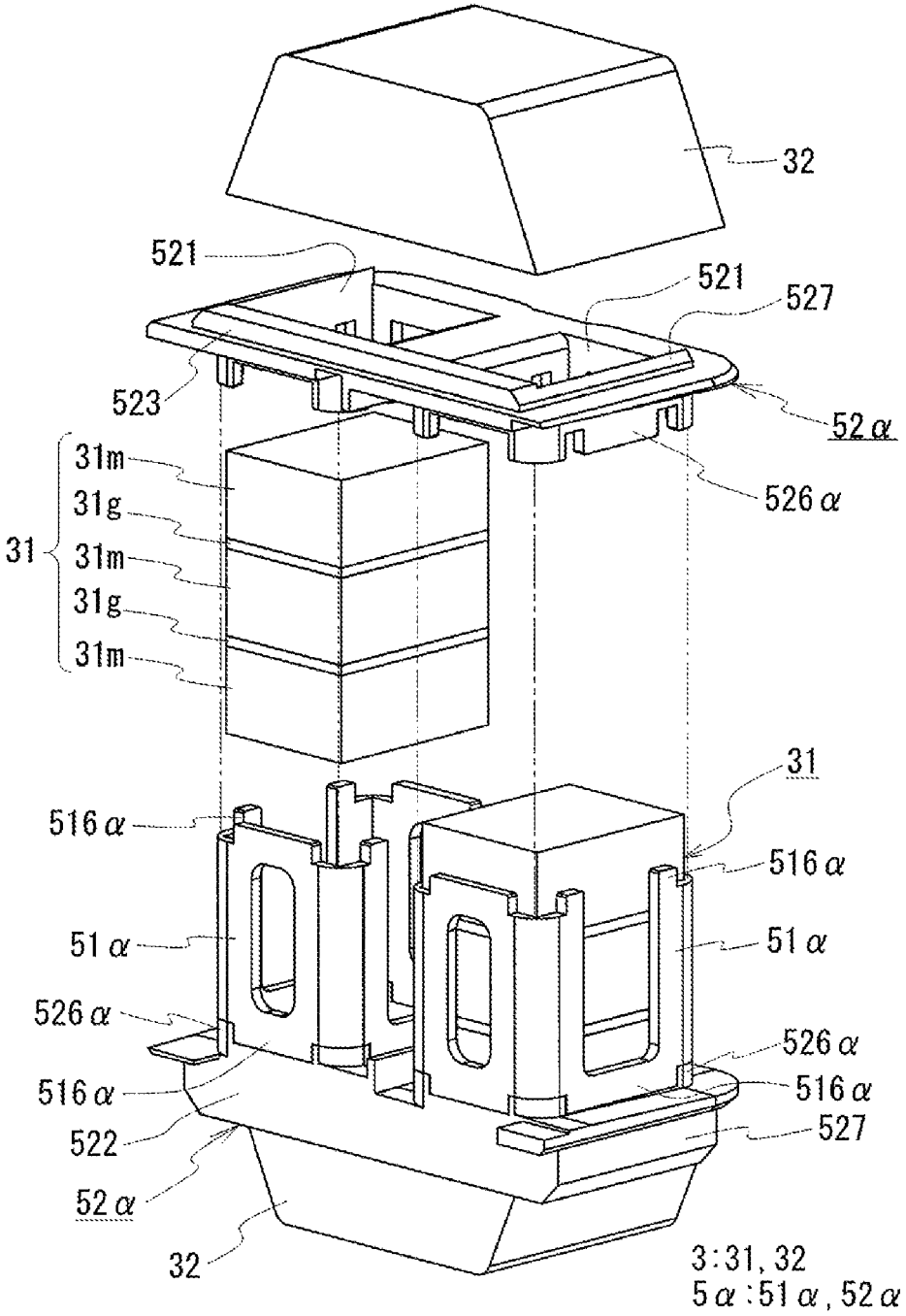
[FIG. 7]

Next, the coil elements are attached to the outer circumference of the surrounding wall portions 51α, with the coil couple portion side of the coil (not shown) oriented downward in FIG. 7. Then, other frame-like portion 52α is attached to the surrounding wall portions 51α, and other outer core portion 32 is attached to the other frame-like portion 52α in the similar manner as described above. Through this step, the positional relationship between the surrounding wall portions 51α and the other frame-like portion 52α is retained, and the other outer core portion 32 is positioned relative to the other frame-like portion 52α. Through the foregoing steps, the combined product made up of the coil and the magnetic core 3 is obtained.

The one trapezoidal face of each of the outer core portions 32 is disposed so as to be brought into contact with the heat dissipation layer of the bottom plate portion, such that the combined product falls from the state shown in FIG. 7 toward the depth side of the drawing. Then, as has been described in the embodiment, the pedestal 522 and the protruding portion 523 of the frame-like portion 52α and the outer core portions 32 are pressed against the heat dissipation layer. At this time, since the engagement of the fitting concave and convex portions 516α and 526α carries out pressing of the frame-like portions 52α, the surrounding wall portions 51α are also pressed. Thus, similarly to the embodiment, the flat plate-like installation face portion of each surrounding wall portion 51α presses the inner circumferential face of the coil. As a result, the turns forming the coil installation face of the coil are aligned.

Similarly to the embodiment having been described above, use of the insulator 5α can eliminate the necessity of using an adhesive agent in forming the magnetic core 3. In particular, the insulator 5α can easily maintain the integrated state achieved by engagement of the surrounding wall portions 51α and the frame-like portions 52α with each other. Therefore, the combined product can easily be handled in disposing the same at the bottom plate portion of the case and the like. Further, similarly to the projecting portion 525 according to the embodiment, the insulator 5α can use the part of the engaging portion (fitting concave and convex portions 516α and 526α) as the pressing function of the installation face portion.

Further, employing the structure in which the back face of one outer core portion 32 is brought into contact with the side wall portion of the case, and a member (for example, a leaf spring) which presses other outer core portion 32 toward one outer core portion 32 is inserted between the back face of other outer core portion 32 and the side wall portion, it becomes possible to prevent the gap length from changing by any external factor such as vibrations or a shock. In such a mode in which the pressing member is used, when the gap members 31*g* are each an elastic gap member formed by an elastic material such as silicone rubber, fluororubber and the like, deformation of the gap members 31*g* can adjust the gap length or absorb a certain amount of dimension error. The pressing members and the elastic gap members can be used in the embodiment and variations having been described above, and in the variation whose description will follow.

{Variation 4}

Alternatively, another mode in which no adhesive agent is used in forming the magnetic core 3 may be, for example, use of a band-like fastening member (not shown) that can retain the magnetic core in an annular manner. The band-like fastening member may be, for example, an element including a band portion disposed at the outer circumference of the magnetic core, and a lock portion attached to one end of the band portion to fix the loop formed by the band portion to a prescribed length. The lock portion may include an insertion hole into which the other end side region of the band portion having an elongated protrusion is inserted, and a tooth portion provided at the insertion hole to mesh with the elongated protrusion of the band portion. Thus, what is suitably used is the band-like fastening member in which a ratchet mechanism is structured by the elongated protrusion at the other end side region of the band portion and the tooth portion of the lock portion, so as to be capable of fixing the loop of the prescribed length.

The material of the band-like fastening member may be a material which is non-magnetic and heat resistant, e.g., capable of withstanding the temperature during operation of the reactor. For example, it may be a metal material such as stainless steel, a non-metallic material such as heat resistant polyamide resin, polyetheretherketone (PEEK) resin, polyethylene terephthalate (PET) resin, polytetrafluoroethylene (PTFE) resin, polyphenylene sulfide (PPS) resin or the like. Commercially available tying members, for example, Ty-Rap (registered trademark of Thomas & Betts International, Inc.), PEEK Tie (ties available from Hellermanntyton Corporation), stainless steel bands (available from Panduit Corp.), may be used.

When the combined product is assembled, in connection with the band-like fastening member, the band portion is wrapped around, for example, in the following order: the outer circumference of one outer core portion; between the outer circumference of one inner core portion and the inner circumferential face of the coil element; the outer circumference of the other outer core portion; and between the outer circumference of the other inner core portion and the inner circumferential face of the coil element. Then, by fixing the loop length by the lock portion, the magnetic core can be fixed in an annular shape. Alternatively, after the combined product made up of the coil and the magnetic core is assembled as has been described in the embodiment and others described above, the band portion is disposed so as to wrap around the outer core portion and the outer circumference of the coil, and the loop length is fixed. Use of such a band-like fastening member makes it possible to integrate the magnetic core without use of an adhesive agent. Therefore, for example when the combined product is disposed at the bottom plate portion, the combined product can easily be handled. Further, the interval between the core pieces can easily be maintained.

Further, employing the structure in which a buffer member is interposed between the outer circumference of the magnetic core or between the outer circumference of the coil and the band-like fastening member, any damage that may be done by the tightening force of the band-like fastening member to the magnetic core and the coil can be suppressed. The material, thickness, number of pieces, disposition place of the buffer member can appropriately be selected such that the tightening force of the magnitude with which the annular magnetic core can retain the prescribed shape acts on the magnetic core. For example, a mold product having the thickness of approximately 0.5 to 2 mm made by molding resin such as ABS resin, PPS resin, PBT resin, or epoxy resin in the shape of the core, a rubber-like plate member such as silicone rubber or the like can be used as the buffer member.

Note that the embodiment having been described above can be changed as appropriate without departing from the gist of the present invention, and the present invention is not limited to the foregoing structure.

Industrial Applicability

The reactor of the present invention can suitably be used as a constituent component of a power converter apparatus such as an in-vehicle converter installed in a vehicle such as a hybrid vehicle, an electric vehicle, a fuel cell vehicle and the like.

Reference Signs List

1: REACTOR
10: COMBINED PRODUCT
2: COIL
2*a*, 2*b*: COIL ELEMENT
2*d*: COIL INSTALLATION FACE
2*r*: COIL COUPLE PORTION
2*w*: WIRE
3: MAGNETIC CORE
31: INNER CORE PORTION
31*e*: END FACE
31*m*: CORE PIECE
31*g*: GAP MEMBER
32: OUTER CORE PORTION
32*e*: INNER END FACE
32*d*: CORE INSTALLATION FACE
4: CASE
40: BOTTOM PLATE PORTION
41: SIDE WALL PORTION
42: HEAT DISSIPATION LAYER
400, 411: ATTACHING PORTION
400*h*, 411*h*: BOLT HOLE
410: TERMINAL BLOCK
410*c*: CONCAVE GROOVE
5, 5α: INSULATOR
51, 51α: SURROUNDING WALL PORTION
511, 512: DIVIDED PIECE
513: FLAT PLATE PORTION (INSTALLATION FACE PORTION)
514: HOOK PORTION
515: WINDOW PORTION
516: ENGAGING CONCAVE PORTION
516α, 526α: FITTING CONCAVE AND CONVEX PORTION
52, 52α: FRAME-LIKE PORTION
521: OPENING PORTION
522: PEDESTAL
523: PROTRUDING PORTION
525: PROJECTING PORTION
526: ENGAGING CONVEX PORTION
527: FRAME PORTION
6: GASKET
8: TERMINAL HARDWARE
81: WELDING FACE
82: CONNECTING FACE
9: TERMINAL FIXING MEMBER
91: BOLT

100: FIXING JIG
101: BODY
102: CORE PRESSING PORTION
103: INSULATOR PRESSING PORTION
104: SUPPORT PORTION
105, 106: BOLT

The invention claimed is:

1. A reactor comprising:

a combined product and a case storing the combined product, the combined product including a coil formed by a wire being spirally wound and a magnetic core which includes a magnetic material and where the coil is disposed, wherein the combined product includes an insulator electrically insulating the coil and the magnetic core from each other, and the case includes a side wall portion that surrounds the combined product, the side wall portion having a first opening portion located in the near side of a fixation target composed of a heat absorber and a second opening portion located on the opposite side of the fixation target, a bottom plate portion being fixed to the fixation target when the reactor is installed in the fixation target, the bottom plate portion closing the first opening portion of the side wall portion, and a heat dissipation layer formed on an inner face of the bottom plate portion to be interposed between the bottom plate portion and the coil, wherein the bottom plate portion and the side wall portion are structured as separate members which are fixed by a fixation member, the bottom plate portion is equal to or higher than the side wall portion in thermal conductivity, the heat dissipation layer is structured by an electrically insulating material whose thermal conductivity is higher than 2 W/m·K, and the insulator includes an installation face portion being interposed between an inner circumferential face of the coil and the magnetic core, and a pressing mechanism pressing the installation face portion against the inner circumferential face of the coil in order to bring the coil into contact evenly with the heat dissipation layer.

2. The reactor according to claim 1, wherein the magnetic core includes an inner core portion where the coil is disposed, and an outer core portion where the coil is not disposed and exposed outside the coil, the insulator includes a surrounding wall portion disposed at an outer circumference of the inner core portion to be interposed between the coil and the inner core portion, and a frame-like portion abutting on an end face of the coil to be interposed between the coil and the outer core portion, wherein the surrounding wall portion and the frame-like portion each have an engaging portion for engaging with each other, the surrounding wall portion includes the installation face portion, the frame-like portion has a projecting portion pressing the installation face portion against the inner circumferential face of the coil when the frame-like portion is assembled with the surrounding wall portion, and the pressing mechanism is structured by the engaging portion and the projecting portion.

3. The reactor according to claim 1, wherein the heat dissipation layer is a multilayer structure structured by an electrically insulating adhesive agent, and the bottom plate portion is structured by an electrically conductive material.

4. The reactor according to claim 1, wherein the side wall portion is structured by an electrically insulating material.

5. The reactor according to claim 1, wherein the heat dissipation layer is a multilayer structure structured by an epoxy base adhesive agent containing an alumina filler, the bottom plate portion is structured by aluminum or aluminum alloy, and the side wall portion is structured by an electrically insulating resin.

6. A reactor manufacturing method comprising:

preparing a combined product made up of a coil and a magnetic core which includes a magnetic material by assembling the coil made of a wire being spirally wound and the magnetic core; and storing the combined product in a case, the case including a bottom plate portion being fixed to a fixation target composed of a heat absorber and a side wall portion provided to stand upright from the bottom plate portion to surround the combined product, the side wall portion is a separate member from the bottom plate portion, the method further comprising:

forming a heat dissipation layer made of an electrically insulating material whose thermal conductivity is higher than 2 W/m·K on an inner face of the bottom plate portion before attaching the side wall portion to the bottom plate portion;

disposing an insulator between the coil and the magnetic core for electrically insulating the coil and the magnetic core from each other, the insulator pressing the coil against the heat dissipation layer to bring the coil into contact evenly with the heat dissipation layer before attaching the side wall portion to the bottom plate portion; and attaching the side wall portion to the bottom plate portion by a fixation member to form the case.

* * * * *